US011118872B2

(12) United States Patent
Goodchild et al.

(10) Patent No.: US 11,118,872 B2
(45) Date of Patent: Sep. 14, 2021

(54) METHODS AND APPARATUS FOR A CONDUCTED ELECTRICAL WEAPON

(71) Applicant: Axon Enterprise, Inc., Scottsdale, AZ (US)

(72) Inventors: Eric Goodchild, Queen Creek, AZ (US); Gerzain Mata, Scottsdale, AZ (US); Magne Nerheim, Paradise Valley, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 9 days.

(21) Appl. No.: 16/577,401

(22) Filed: Sep. 20, 2019

(65) Prior Publication Data

US 2020/0109924 A1 Apr. 9, 2020

Related U.S. Application Data

(60) Provisional application No. 62/742,068, filed on Oct. 5, 2018.

(51) Int. Cl.
*F41H 13/00* (2006.01)
*F41A 17/06* (2006.01)

(52) U.S. Cl.
CPC ..... *F41H 13/0025* (2013.01); *F41A 17/063* (2013.01); *F41H 13/0031* (2013.01)

(58) Field of Classification Search
CPC .. F41H 13/00; F41H 13/0012; F41H 13/0025; F41H 13/0031; F41H 13/0087; F41A 17/06; F41A 17/63; F41B 15/04
USPC ..... 361/230–235
See application file for complete search history.

(56) References Cited

U.S. PATENT DOCUMENTS 8,036,000 B2 * 10/2011 Ying ..... H02M 3/3376 363/21.02
8,098,474 B2 1/2012 Smith et al.
8,356,438 B2 * 1/2013 Brundula ..... H05C 1/06 42/1.08
8,428,899 B2 * 4/2013 Miller ..... F41H 13/0025 702/117
9,939,232 B2 4/2018 Nerheim
10,015,871 B2 7/2018 Handel et al.
(Continued)

OTHER PUBLICATIONS

International Searching Authority, International Search Report and Written Opinion for International Application No. PCT/US2019/054232, dated Jan. 23, 2020.

*Primary Examiner* — Yemane Mehari
(74) *Attorney, Agent, or Firm* — Justin Powley

(57) ABSTRACT

A conducted electrical weapon ("CEW") launches wire-tethered electrodes from multiple cartridges to provide a stimulus signal through a human or animal target to impede locomotion of the target. The CEW may detect the quality of the electrical coupling (e.g., connection) of pairs of electrodes with the target. In accordance with the quality of the connections, the CEW may provide pulses of a stimulus signal to the various connections between electrode pairs in accordance with a sequence. The sequence may provide pulses at a first maximum pulse rate to any one connection to increase the likelihood of inducing neuromuscular incapacitation ("NMI") and to save energy. The sequence may provide pulses to all connections at a second maximum pulse rate to increase the likelihood of inducing NMI and to save energy.

20 Claims, 9 Drawing Sheets

(56) References Cited

U.S. PATENT DOCUMENTS

| | | | | |
|---|---|---|---|---|
| 10,024,636 | B2 | 7/2018 | Nerheim | |
| 10,060,710 | B2 * | 8/2018 | Nerheim | F41H 13/0012 |
| 10,473,438 | B2 * | 11/2019 | Nerheim | F41H 13/0025 |
| 2004/0156163 | A1 | 8/2004 | Nerheim | |
| 2007/0081293 | A1 | 4/2007 | Brundula et al. | |
| 2014/0233146 | A1 * | 8/2014 | Gavin | F41H 13/0025<br>361/232 |
| 2017/0241753 | A1 * | 8/2017 | Nerheim | F41H 13/0012 |
| 2017/0245355 | A1 * | 8/2017 | Handel | H05C 3/00 |
| 2017/0304639 | A1 | 10/2017 | Cheatham et al. | |
| 2018/0259303 | A1 * | 9/2018 | Nerheim | F41H 13/0025 |
| 2019/0257623 | A1 * | 8/2019 | Nerheim | H05C 1/04 |

* cited by examiner

METHODS AND APPARATUS FOR A CONDUCTED ELECTRICAL WEAPON

FIELD OF THE INVENTION

Embodiments of the present invention relate to a conducted electrical weapon ("CEW") (e.g., electronic control device) that launches electrodes to provide a current through a target to impede locomotion of the target.

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
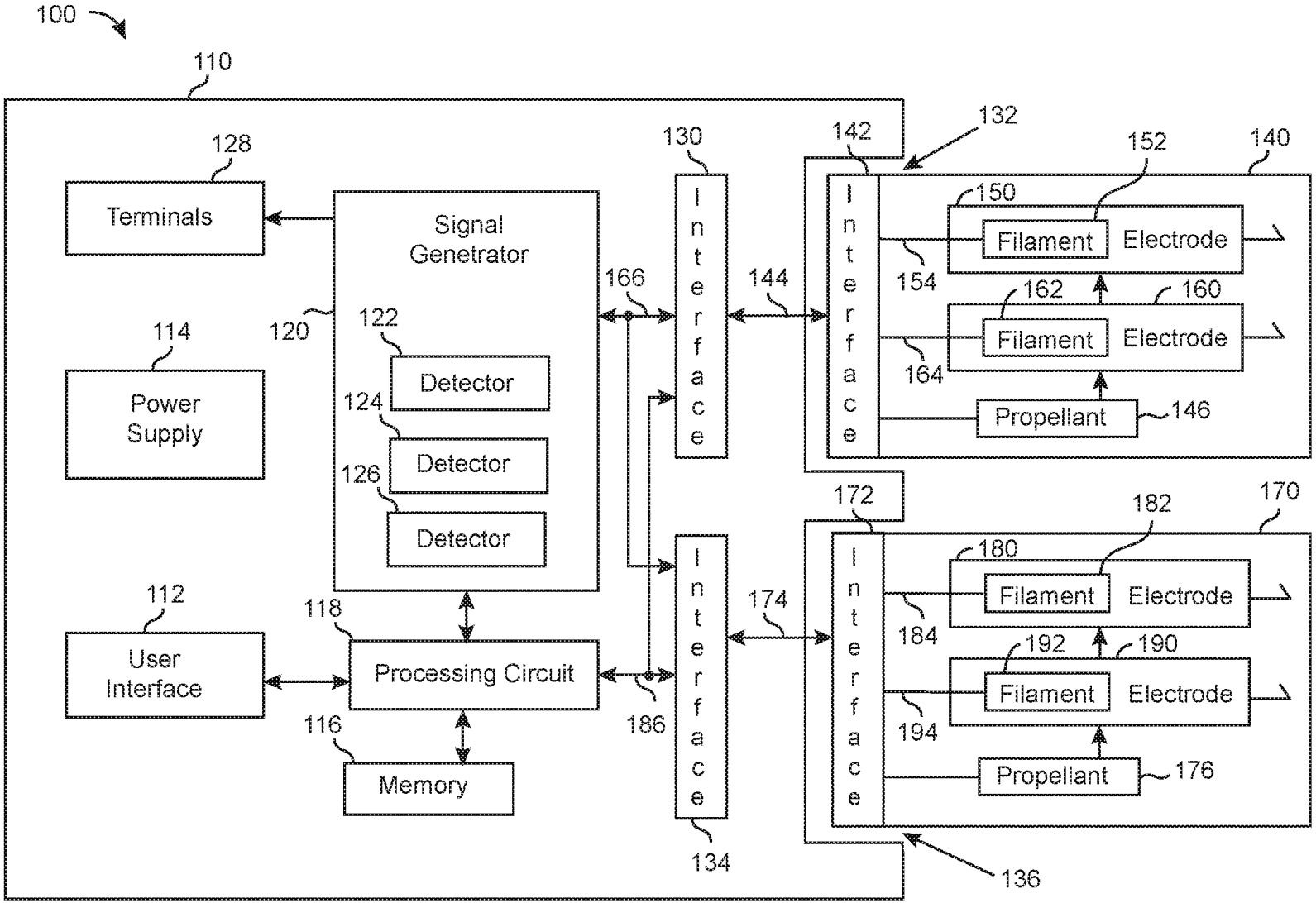
FIG. 1 is a functional diagram of a conducted electrical weapon ("CEW") according to various aspects of the present disclosure.

A CEW provides (e.g., delivers) a current (e.g., stimulus signal, pulses of current, pulses of charge, etc.) through tissue of a human or animal target. The stimulus signal provides a charge into target tissue. The stimulus signal may interfere with voluntary locomotion (e.g., walking, running, moving, etc.) of the target. The stimulus signal may cause pain. The pain may encourage the target to stop moving. The stimulus signal may cause skeletal muscles of the target to become stiff (e.g., lock up, freeze, etc.). The stiffening of the skeletal muscles in response to a stimulus signal may be referred to as neuromuscular incapacitation ("NMI"). NMI disrupts voluntary control of the muscles of the target. The inability of the target to control its muscles interferes with locomotion by the target.

A stimulus signal may be delivered through a target via terminals coupled to the CEW. Delivery via terminals may be referred to as local delivery (e.g., a local stun). During local delivery, the terminals are brought close to the target by positioning the CEW proximate to the target. The stimulus signal is delivered through target tissue via the terminals. To provide local delivery, the user of the CEW is generally within arm's reach of the target and brings the terminals of the CEW into contact with or proximate to the target.

A stimulus signal may be delivered through a target via one or more wire-tethered electrodes. Delivery via wire-tethered electrodes may be referred to as remote delivery (e.g., a remote stun). During remote delivery, the CEW may be separated from the target up to the length (e.g., 15 feet, 20 feet, 30 feet, etc.) of the wire tether. The CEW launches one or more electrodes toward the target. As the electrodes fly (e.g., travel) toward the target, their respective wire tethers deploy behind the electrodes. The wire tether electrically couples the CEW to the electrode. The electrode may electrically couple to the target thereby coupling the CEW to the target. When one or more electrodes land on or are positioned proximate to target tissue, the current may be provided through the target through the one or more electrodes.

Conventional CEWs launch at least two electrodes to remotely deliver a stimulus signal through a target. The at least two electrodes land on (e.g., impact, hit, strike, etc.) or are positioned proximate to target tissue to form a circuit through the first tether and electrode, target tissue, and the second tether and electrode.

Terminals or electrodes that contact or are proximate to target tissue deliver the stimulus signal through the target. Contact of a terminal or electrode with target tissue establishes an electrical coupling (e.g., circuit) with target tissue. Electrodes may include a spear that may pierce target tissue to contact the target. A terminal or electrode that is proximate to target tissue may use ionization to establish an electrical coupling with target tissue. Ionization may also be referred to as arcing.

In use, a terminal or electrode may be separated from target tissue by the target's clothing or a gap of air. A signal generator of the CEW may provide the stimulus signal (e.g., current or pulses of current) at a high voltage (e.g., in the range of 40,000 to 100,000 volts) to ionize the air in the clothing or the air in the gap that separates the terminal or electrode from target tissue. Ionizing the air establishes a low impedance ionization path from the terminal or electrode to target tissue that may be used to deliver the stimulus signal into target tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to target tissue. Lacking the ionization path, the impedance between the terminal or electrode and target tissue is high. A high voltage in the range of about 50,000 volts can ionize air in a gap of up to about one inch (wherein "about" as used in this sentence refers only to +/−1000 volts or +/−0.25 inches, respectively).

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. Once the electrode or terminal is electrically coupled to the target, the low voltage portion of the pulse delivers an amount of charge into target tissue via the ionization path. For an electrode or terminal that electrically couples to a target by contact (e.g., touching, spear embedded into tissue, etc.), the high portion of the pulse and the low portion of the pulse both deliver charge to target tissue. Generally, the low voltage portion of the pulse delivers the majority of the charge of the pulse into target tissue.

The high voltage portion of a pulse of the stimulus signal may be referred to as the spark or ionization portion. The low voltage portion of a pulse may be referred to as the muscle portion.

Conventional CEWs typically include at least two terminals at the face of the CEW. A CEW may include two terminals for each bay that accepts a deployment unit (e.g., cartridge). The terminals are spaced apart from each other. In the event that the electrodes of the deployment unit in the bay have not been deployed (e.g., launched), the high voltage impressed across the terminals will result in ionization of the air between the terminals. The arc between the terminals may be visible to the naked eye. When launched electrodes do not electrically couple to a target, the current that would have been provided via the electrodes may arc across the face of the CEW via the terminals.

The likelihood that the stimulus signal will cause NMI increases when the electrodes that deliver the stimulus signal are spaced apart about six or more inches so that the current from the stimulus signal flows through six or more inches of target tissue (wherein "about" as used in this sentence refers only +/− one inch). Preferably, the electrodes should be spaced apart twelve or more inches on the target. Because the terminals on a CEW are less than six inches apart, a stimulus signal delivered through target tissue via terminals likely will not cause NMI, only pain.

A series of pulses may include two or more pulses separated in time. Each pulse delivers an amount of charge into target tissue. When electrodes are appropriately spaced, the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. Most conventional CEWs are hand-held and use batteries to provide the pulses of the stimulus signal. When the amount of charge per pulse is high and the pulse rate is high, the CEW may use more energy than is needed to induce NMI. Using more energy than is needed depletes the battery more quickly.

Empirical testing has shown that the power of the battery may be conserved with a high likelihood of causing NMI when the pulse rate is less than 44 pps and the charge per pulse is about 63 microcoulombs (wherein "about" as used in this sentence refers only to +/−5 microcoulombs). Empirical testing has shown that a pulse rate of 22 pps and 63 microcoulombs per pulse via a pair of electrodes will induce NMI when the electrode spacing is about 12 inches (wherein "about" as used in this sentence refers only to +/−1 inch).

A CEW according to various aspects of the present disclosure includes a handle and one or more deployment units. A handle includes one or more bays for receiving the deployment units. A deployment unit may be removably positioned in (e.g., inserted into or coupled to) a bay. A deployment unit may releasably electrically, electronically, and/or mechanically couple to a bay. A deployment may launch one or more electrodes toward a target to remotely deliver the stimulus signal through the target.

Typically, a deployment unit includes two electrodes that are launched at the same time. Launching the electrodes may be referred to as activating (e.g., firing) a deployment unit. Generally, activating a deployment unit launches all of the electrodes of the deployment unit, so the deployment unit may be activated only once to launch electrodes. After use (e.g., activation, firing), a deployment unit may be removed from the bay and replaced with an unused (e.g., not fired, not activated) deployment unit to permit launch of additional electrodes.

With reference to FIG. 1, and according to various aspects of the present disclosure, a CEW 100 includes a handle 110 and one or more deployment units 140 and 170. Handle 110 includes a user interface 112, a power supply 114, a memory 116, a processing circuit 118, a signal generator 120, detectors 122, 124, and 126, terminals 128, and interfaces 130, 134. Interfaces 130,134 may electrically couple to signal generator 120 via a bus (e.g., one or more conductors) 166, and/or through any other suitable electrical coupling. Interfaces 130, 134 may electrically couple to processing circuit via bus 186, and/or through any other suitable electrical coupling. Terminals 128 may be coupled to, or positioned proximate to, an outer surface of handle 110. Terminals 128 may be electrically coupled to signal generator 120.

Deployment unit 140 includes an interface 142, an electrode 150, an electrode 160, and a propellant 146. Electrode 150 includes a filament 154 stowed in a store 152. Electrode 160 includes a filament 164 stowed in a store 162. Filament 154 and 164 electrically couple to interface 142. Interface 142 electrically couples to interface 130 via a bus 144, and/or through any other suitable electrical coupling. Bus 144 decouples from interface 142 when deployment unit 140 is removed from bay 132.

Deployment unit 170 includes an interface 172, an electrode 180, an electrode 190, and a propellant 176. Electrode 180 includes a filament 184 stowed in a store 182. Electrode 190 includes a filament 194 stowed in a store 192. Filament 184 and 194 electrically couple to interface 172. Interface 172 electrically couples to interface 134 via a bus 174, and/or through any other suitable electrical coupling. Bus 174 decouples from interface 172 when deployment unit 170 is removed from bay 136.

Figure 2:
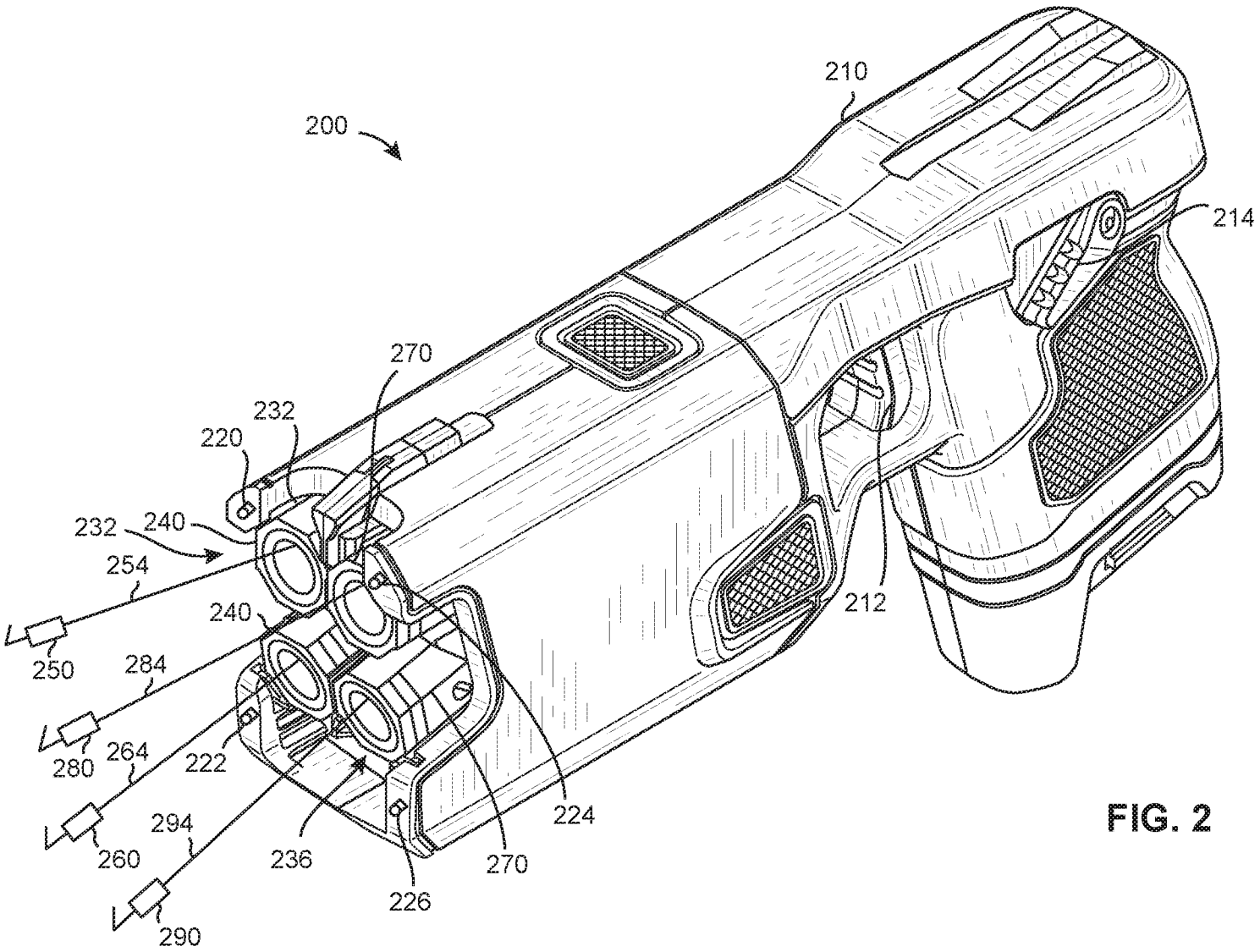
FIG. 2 is a perspective view of an implementation of a CEW with two tethered electrodes deployed from each of two deployment units.

For example, in an implementation referring to FIG. 2, a deployment unit 240 (e.g., a cartridge) is inserted into a bay 232. A deployment unit 270 is inserted into a bay 236. Deployment unit 240 includes electrodes 250 and 260. Electrodes 250 and 260 electrically couple to the interface (not shown) of deployment unit 240 via filaments 254 and 264 respectively. Deployment unit 270 includes electrodes 280 and 290. Electrodes 280 and 290 electrically couple to the interface (not shown) of deployment unit 270 via filaments 284 and 294 respectively. Terminals 220 and 222 are positioned proximate to bay 232. Terminals 224 and 226 are positioned proximate to bay 236.

A power supply provides power (e.g., energy). For a conventional CEW, a power supply provides electrical power. Providing electrical power may include providing a current at a voltage. Electrical power from a power supply may be provided as a direct current ("DC") or an alternating current ("AC"). A battery may perform the functions of a power supply. A power supply may provide energy for performing the functions of a CEW. A power supply may provide the energy for a stimulus signal. A power supply may provide energy for operating the electronic and/or electrical components (e.g., parts, subsystems, circuits, etc.) of a CEW and/or one or more deployment units.

The energy of a power supply may be renewable or exhaustible. A power supply may be replaceable. The energy from a power supply may be converted from one form (e.g., electrical, magnetic, thermal, etc.) to another form to perform the functions of a CEW.

For example, with reference again to FIG. 1, power supply 114 provides power for the operation of user interface 112, signal generator 120, processing circuit 118, memory 116, detector 122, detector 124, and detector 126. Power supply 114 provides the energy to form the current pulses of a stimulus signal.

A user interface may include one or more controls (e.g., switches, buttons, portions of a touch screen, etc.) that permit a user to interact and/or communicate (e.g., provide information, receive information, etc.) with a CEW. Via a user interface, a user may control (e.g., influence, select, cause, etc.) an operation (e.g., function) of a CEW. A user interface may include any suitable device for manual and/or voice activated operation by a user to control the operation of a CEW.

A control includes any electrical, electronic, mechanical, or electromechanical device suitable for manipulation (e.g., operation) by a user. A control may establish or break an electrical circuit. A control may include a portion of a touch screen. A control may include any type of switch (e.g., pushbutton, rocker, key, rotary, slide, thumbwheel, toggle, etc.). Operation of a control may occur as a result of manual operation of a switch. Operation of a control may occur by the selection of a portion of a touch screen. Operation of a control may provide information to a CEW. Operation of a control may result in performance of a function, halting performance of a function, and/or resuming performance of a function of the CEW.

A processing circuit may detect the operation of a control. A processing circuit may perform a function of the CEW in response to an operation of a control. A processing circuit may perform a function, halt a function, resume a function, and/or suspend a function of the CEW responsive to operation of one or more controls. A control may provide analog or binary information to a processing circuit.

A user interface may provide information to a user. A user may receive visual and/or audible information from a user interface. A user may receive visual information via devices that visually display (e.g., present, show, etc.) information (e.g., LCDs, LEDs, light sources, graphical and/or textual display, display, monitor, touchscreen, etc.). A user interface may include a communication circuit for transmitting information to an electronic device (e.g., smart phone, tablet, etc.) for presentation to a user.

For example, with reference again to FIG. 2, the user interface of CEW 200 includes controls 212 and 214. Control 214 is a switch that performs the function of a safety. When control 214 is enabled (e.g., safety on), CEW 200 cannot launch electrodes or provide a stimulus signal. When control 214 is disabled (e.g., safety off), CEW 200 may perform the functions of a CEW. Control 212 is a switch that performs the function of a trigger. When control 214 is disabled and control 212 is operated (e.g., pulled), CEW begins the process of providing a stimulus signal for disabling a target and/or launching electrodes. Activating control 214 starts the operation of CEW 200 to provide the stimulus signal for a period of time (e.g., 5 seconds). CEW 200 may include other controls or a display as part of the user interface of CEW 200.

A processing circuit includes any circuitry, electrical components, electronic components, software, computer-readable mediums, and/or the like configured to perform various operations and functions. A processing circuit may include circuitry that performs (e.g., executes) a stored program. A processing circuit may include a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or the like.

A processing circuit may include passive electronic devices (e.g., resistors, capacitors, inductors, etc.) and/or active electronic devices (op amps, comparators, analog-to-digital converters, digital-to-analog converters, programmable logic, SRCs, transistors, etc.). A processing circuit may include data buses, output ports, input ports, timers, memory, arithmetic units, and/or the like.

A processing circuit may provide and/or receive electrical signals whether digital and/or analog in form. A processing circuit may provide and/or receive digital information via a data bus using any protocol. A processing circuit may receive information, manipulate the received information, and provide the manipulated information. A processing circuit may store information and retrieve stored information. Information received, stored, and/or manipulated by the processing circuit may be used to perform a function, control a function, and/or to perform (e.g., execute) a stored program.

A processing circuit may control the operation and/or function of other circuits and/or components of a system such as a CEW. A processing circuit may receive status information regarding the operation of other components, perform calculations with respect to the status information, and provide commands (e.g., instructions) to one or more other components. A processing circuit may command another component to start operation, continue operation, alter operation, suspend operation, or cease operation. Commands and/or status may be communicated between a processing circuit and other circuits and/or components via any type of bus (e.g., SPI bus) including any type of data/address bus.

A processing circuit may include or be in electronic communication with a computer-readable medium. The computer-readable medium may store, retrieve, and/or organize data. As used herein, the term "computer-readable medium" includes any storage medium that is readable by a machine (e.g., computer, processor, processing circuit, etc.). Storage medium includes any devices, materials, and/or structures used to place, keep, and retrieve data (e.g., information). A storage medium may be volatile or non-volatile. A storage medium may include any semiconductor (e.g., RAM, ROM, EPROM, flash, etc.), magnetic (e.g., hard disk drive (HDD), etc.), solid state (e.g., solid-state drive (SSD), etc.), optical technology (e.g., CD, DVD, etc.), or combination thereof. Computer-readable medium includes storage medium that is removable or non-removable from a system. Computer-readable medium may store any type of information, organized in any manner, and usable for any purpose such as computer readable instructions, data structures, program modules, or other data. The computer-readable medium may comprise a non-transitory computer-readable medium. The non-transitory computer-readable medium may include instructions stored thereon. Upon execution by the processing circuit, the instructions may allow the processing circuit to perform various functions and operations disclosed herein.

A signal generator provides a signal (e.g., stimulus signal, current, current pulse, a series of current pulses, etc.). A signal may include a pulse of current. A signal may include two or more (e.g., a series of) current pulses. A current pulse provided by a signal generator may include a high voltage portion for electrically coupling a CEW to a target as discussed above. The high voltage portion of a pulse may ionize air in one or more gaps in series with the signal generator. Ionizing air may establish one or more ionization paths to deliver the current pulse through target tissue as discussed above. A pulse may provide an amount of charge to target tissue. A signal generator may provide current pulses at a rate of so many pulses per second. The signal comprised of the pulses of current (e.g., stimulus signal) may interfere with (e.g., impede) locomotion of the target. The signal may impede locomotion by inducing fear, pain, and/or NMI.

The pulses of a stimulus signal may be delivered at a rate (e.g., 22 pps, 44 pps, 50 pps, etc.) for a period of time (e.g., 5 seconds, etc.). Each pulse of the stimulus signal may provide an amount of charge (e.g., 63 microcoulombs, etc.) as discussed above. Each pulse may establish electrical connectivity (e.g., ionizing air in one or more gaps) and interfere with locomotion of the target by providing an amount of charge per pulse to target tissue.

A signal generator includes circuits for receiving electrical energy and for providing the stimulus signal. Electrical/electronic circuits (e.g., components) of a signal generator may include capacitors, resistors, inductors, spark gaps, transformers, silicon-controlled rectifiers ("SCRs"), analog-to-digital converters, and/or the like. A processing circuit may cooperate with and/or control the circuits of a signal generator to produce a stimulus signal.

A signal generator may receive electrical energy from a power supply. A signal generator may convert the energy from one form of energy into a stimulus signal for ionizing gaps of air and interfering with locomotion of a target. A processing circuit may cooperate with and/or control a power supply in its provision of energy to a signal generator. A processing circuit may cooperate with and/or control a signal generator in converting the received electrical energy into a stimulus signal. A processing circuit may cooperate with and/or control a signal generator to select a pair of electrodes for providing the stimulus signal.

A detector detects (e.g., measures, witnesses, discovers, determines, etc.) a physical property (e.g., intensive, extensive, isotropic, anisotropic, etc.). A physical property may include any physical property such as, for example, capacitance, electric charge, electric impedance, and electric potential. A detector may detect a quantity, a magnitude, and/or a change in a physical property. A detector may detect a physical property and/or a change in a physical property directly and/or indirectly. A detector may detect a physical property and/or a change in a physical property of an object. A detector may detect a physical quantity (e.g., extensive, intensive). A detector may detect a change in a physical quantity directly and/or indirectly. A physical quantity may include an amount of time, an elapse (e.g., lapse, expiration) of time, an electric current, an amount of electrical charge, a current density, an amount (e.g., magnitude) of capacitance, an amount of resistance, a magnitude of a voltage, and/or a current. A detector may detect one or more physical properties and/or physical quantities at the same time or at least partially at the same time.

A detector may transform a detected physical property from one physical property to another physical property (e.g., electrical to kinetic). A detector may transform (e.g., mathematical transformation) a detected physical quantity. A detector may relate a detected physical property and/or physical quantity to another physical property and/or physical quantity. A detector may detect one physical property and/or physical quantity and deduce the existence of another physical property and/or physical quantity.

A detector may cooperate with a processing circuit, such as processing circuit 118 (with brief reference to FIG. 1), or may include a processing circuit for detecting, transforming, relating, and deducing physical properties and/or physical quantities. A processing circuit may include any circuit for detecting, transforming, relating, and deducing physical properties and/or physical quantities. For example, a processing circuit may include a voltage sensor, a current sensor, a charge sensor, a light sensor, a heat sensor (e.g., thermometer), an electromagnetic signal sensor, and/or any other suitable or desired sensor.

A detector may provide information (e.g., report). A detector may provide information regarding a physical property and/or a change in a physical property. A detector may provide information regarding a physical quantity (e.g., magnitude) and/or a change in a physical quantity. A detector may provide information to a processing circuit.

A detector may detect physical properties for determining whether a current was delivered to a target.

A filament (e.g., wire, wire tether) conducts a current. A filament electrically couples a signal generator to an electrode. A filament carries a current at a voltage for ionizing air in one or more gaps and/or impeding locomotion. A filament mechanically couples to an electrode. A filament mechanically couples an interface of a deployment unit. A filament deploys from a store in the electrode upon launch of an electrode. Movement of an electrode toward a target deploys (e.g., pulls) the filament from the store to deploy the filament. A filament extends (e.g., stretches, deploys) between a deployment unit in a handle and a target.

An electrode, as discussed above, couples to a filament and is launched toward a target to deliver a current through the target. An electrode may include aerodynamic structures to improve accuracy of flight of the electrode toward the target. An electrode may include structures (e.g., spear, barbs, etc.) for mechanically coupling to a target.

A propellant propels (e.g., launches) one or more electrodes from a deployment unit toward a target. A propellant applies a force (e.g., from an expanding gas) on a surface of the one or more electrodes to push (e.g., launch) the one or more electrodes from the deployment unit toward the target. The force applied to the one or more electrodes is sufficient to accelerate the electrodes to a velocity suitable for traversing a distance to a target, for deploying the filaments stowed in the one or more electrodes, and for coupling, if possible, the electrodes to the target. A processing circuit may ignite a propellant to launch electrodes. A processing circuit may provide a signal for igniting the propellant via an interface (e.g., 130, 134, 142, 172, with brief reference to FIG. 1). A processing circuit may ignite a propellant in response to operation of a control (e.g., control 212, with brief reference to FIG. 2).

A pair of terminals, as discussed above, may conduct a stimulus signal. Two or more terminals may provide a stimulus signal through target tissue during a local delivery. Two or more terminals may electrically couple to a target to form a circuit through target tissue. A signal generator may apply a voltage across two or more terminals. A voltage applied across terminals may ionize the air between the terminals as discussed above. Ionizing air between terminals causes a visible arc to appear between the terminals.

In an implementation, and with reference again to FIG. 2, terminals 220 and 222 are positioned proximate to the top and proximate to the bottom of bay 232 respectively. Terminals 224 and 226 are positioned proximate to the top and proximate to the bottom of bay 236 respectively. Applying a stimulus signal may cause ionization between terminals 220 and 222 and/or terminals 224 and 226 respectively.

With reference again to FIG. 1, processing circuit 118 controls and/or coordinates the operation of handle 110. Processing circuit 118 may control and/or coordinate the operation of some or all aspects of operation of deployment unit 140 and 170. In an implementation, processing circuit 118 includes a microprocessor that executes a stored program or instruction. Memory 116 stores the stored program. Memory 116 may further store information needed, received, and/or determined by processing circuit 118. Memory 116 may further comprise a non-transitory computer-readable memory configured to store instructions for execution by processing circuit 118, as discussed further herein. Processing circuit 118 includes input ports, output ports, and/or data busses for communicating with user interface 112, signal generator 120, detector 122, detector 124, detector 126, and/or deployment units 140 and 170 to receive notices and/or information and to provide information and/or commands (e.g., control signals).

Processing circuit 118 receives notices (e.g., signals) and information from user interface 112. Processing circuit 118 performs the functions of CEW 100 responsive to notices and/or information from user interface 112. Processing circuit 118 may control the operation, in whole or part, of user interface 112, signal generator 120, detector 122, detector 124, detector 126, and/or deployment units 140 and 170 to perform an operation of CEW 100.

For example, and with reference to FIGS. 1 and 2, a user may operate control 212, while control 214 is disabled (e.g., safety off), to indicate the user's desire to deliver a stimulus signal to a target. Processing circuit 118 may receive the notice from user interface 112 regarding the operation of control 212. Responsive to the notice, processing circuit 118 may ignite, or cause to ignite, the propellant in one or more deployment units to launch electrodes. Processing circuit 118 may instruct and/or control signal generator 120 to provide a stimulus signal. Processing circuit 118 may instruct and/or control detector 122, detector 124, and/or detector 126 to gather information used to determine the likelihood that the stimulus signal was delivered through target tissue.

Processing circuit 118 may receive information from the other components (e.g., devices) of handle 110 and/or deployment units 140 and 170 regarding performance of an operation. For example, processing circuit 118 may receive information from detector 122, detector 124, and/or detector 126 as to what was detected. Processing circuit 118 may receive information from signal generator 120 regarding the stimulus signal, such as, for example, information regarding voltage, charge, and/or current. Processing circuit 118 may use received information to determine whether the stimulus signal was delivered through the target. Processing circuit 118 may use received information to determine whether one or more electrodes are electrically coupled to the target. Processing circuit 118 may use received information to control delivery of future stimulus signals.

Processing circuit 118, handle 110, deployment unit 140, and/or deployment unit 170 may communicate information and/or control signals in any manner using any structures such as, for example, traces (e.g., conductors, wires, PCB traces, etc.) for signals, serial communication links, parallel busses for address and/or data, and/or the like.

Signal generator 120 receives energy from power supply 114 and control signals from processing circuit 118 to provide the stimulus signal. Signal generator 120 may provide the stimulus signal to terminals and/or electrodes. Signal generator 120 receives control signals from processing circuit 118 to determine one or more characteristics of the stimulus signal. Processing circuit 118 may control the operation of signal generator 120 to deliver a stimulus signal that has a pre-determined number of current pulses, current pulses at a number of pulses per second (e.g., rate), current pulses that provide an amount of current per pulse, and/or a duration of time (e.g., 5 seconds) for delivering current pulses.

Processing circuit 118 may further control signal generator 120 so that pulse of the stimulus signal is provided to some electrodes of deployment units 140 and 170, but not other electrodes. Processing circuit 118 may select the electrodes to which signal generator 120 provides a pulse. Processing circuit 118 may instruct signal generator 120 to alternate providing pulses of the stimulus signal to different deployed pairs of electrodes.

A pair of electrodes means two electrodes. Two electrodes may be selected from a collection (e.g., group) of two or more electrodes. A stimulus signal may be provided to the pair of electrodes that have been selected.

Figure 3:
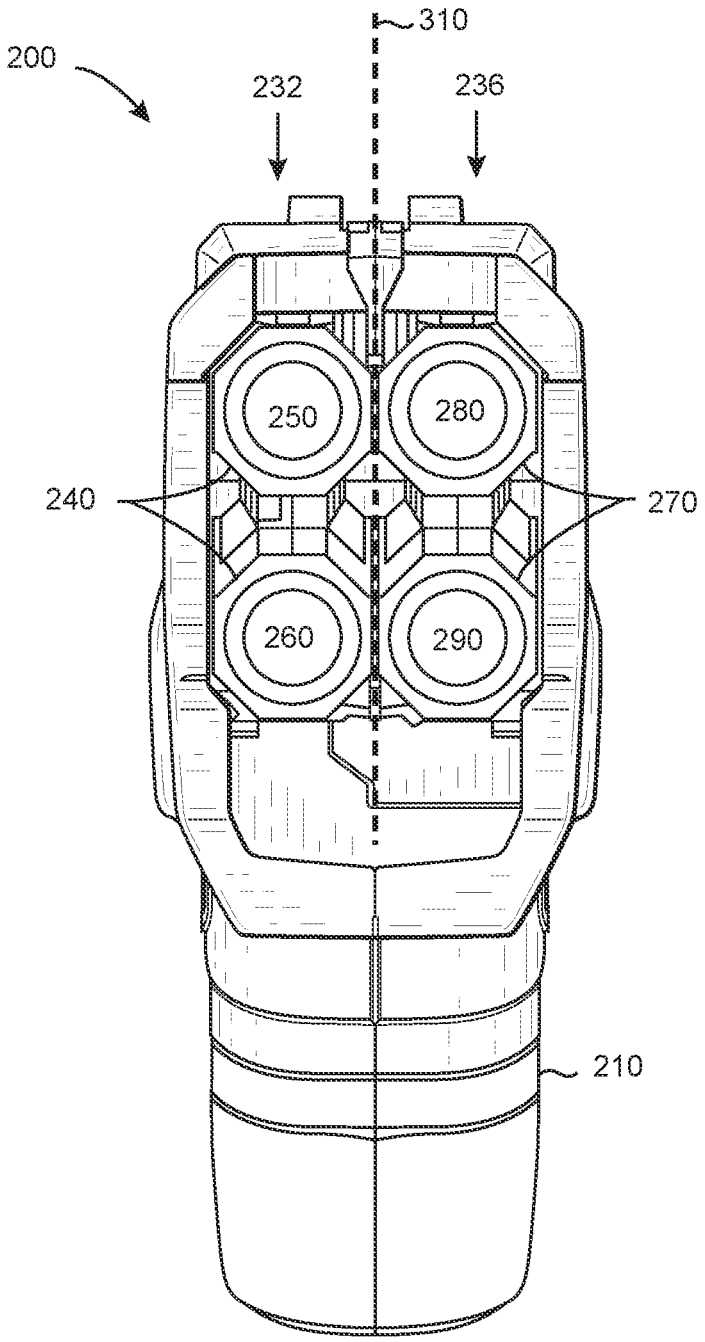
FIG. 3 is a front view of the CEW of FIG. 2 before the launch of the electrodes from the deployment units.
Figure 4:
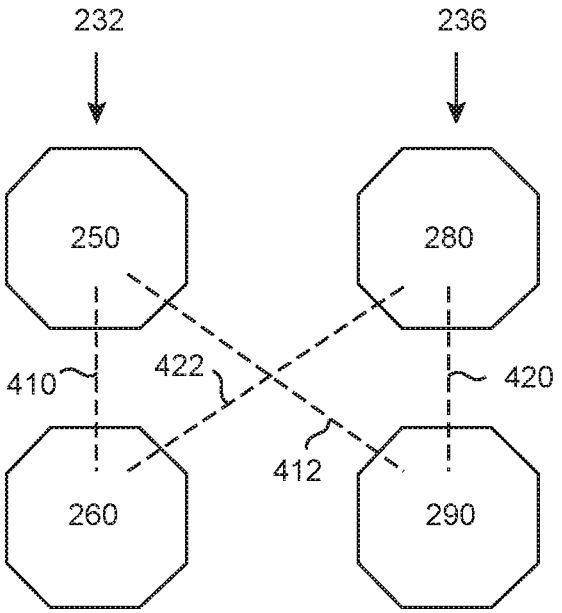
FIG. 4 is a diagram of the electrodes of FIG. 2 and the possible electrical connections between the electrodes.

For example, referring to FIGS. 3 and 4, CEW 200 includes electrodes 250 and 260 of deployment unit 240 and electrodes 280 and 290 of deployment unit 270. In the implementation of CEW 200, electrodes 250 and 280 are coupled to a positive voltage (e.g., potential) while electrodes 260 and 290 are coupled to a negative voltage. A pair of electrodes selected to provide a pulse of the stimulus signal includes one electrode coupled to a positive voltage (e.g., positive electrode) and one electrode coupled to a negative voltage (e.g., negative electrode). The pairs of electrodes of CEW 200 that may be selected to provide the stimulus signal include electrodes 250 and 260, electrodes 280 and 290, electrodes 250 and 290, and electrodes 280 and 260.

For example, if only electrodes 250 and 260 have been launched, they are the only electrodes that may be selected to deliver a stimulus signal. Delivering a stimulus signal via electrodes 250 and 260 may be referred to as providing the stimulus signal via connection (e.g., circuit) 410. For example, if only electrodes 280 and 290 have been launched, they are the only electrodes that may be selected to deliver a stimulus signal. Delivering a stimulus signal via electrodes 280 and 290 may be referred to as providing the stimulus signal via connection 420. For example, if all four electrodes have been launched, then additional electrode pairs may be used to deliver the stimulus signal. The possible electrode pairs and the connection by which they are referred are provided in Table 1 below. Connections 412 and 422 are referred to as cross-connections because the selected electrodes are from different deployment units.

TABLE 1

Electrode Pairs and Connection Names

| Positive Electrode | Negative Electrode | Connection Name |
|---|---|---|
| 250 | 260 | connection 410 |
| 250 | 290 | connection 412 |
| 280 | 290 | connection 420 |
| 280 | 260 | connection 422 |

A CEW is not limited to having two deployment units. A CEW is not limited to launching 2 or 4 electrodes. A CEW may have any number of bays. A deployment unit may have any number of electrodes. Any number of positive electrodes may be launched. Any number of negative electrodes may be launched. A connection may be established between any positive electrode and any negative electrode.

For example, in an implementation, a CEW includes three bays for receiving three respective deployment units. Each deployment unit has two electrodes: one positive, one negative. A connection may be established between the positive electrode from any deployment unit and the negative electrode from any deployment unit. In another implementation, each deployment unit includes three electrodes. For example, one electrode may be a positive electrode and the remaining two electrodes may be negative electrodes. For example, two electrodes may be positive electrodes and the remaining electrode may be a negative electrode. The electrodes of different polarity from the same deployment unit may establish connections. Electrodes of different polarity launched from any number of deployment units may establish connections.

A processing circuit may control the launch of electrodes from one or more deployment unit, so a processing circuit knows which electrodes have been launched. Because the processing circuit knows which electrodes have been launched, the processing circuit may select a pair of electrodes or alternate between pairs of electrodes for providing the stimulus signal. However, if the processing circuit determines which electrodes are electrically coupled to target tissue or which electrodes are electrically coupled with the target through ionization, then the processing circuit may select pairs of electrodes from those electrodes that are electrically coupled (e.g., spear penetrated tissue) or can be electrically coupled (e.g., via ionization) to the target. For the sake of clarity, an electrode that is electrically coupled to target tissue through contact (e.g., spear embedded) or by ionization of air in a gap between the electrode and target tissue is said to be electrically coupled (e.g., connected) to the target. Two electrodes that are electrically coupled to a target form a circuit (e.g., connection) through target tissue. Selecting electrodes from those electrodes that are electrically coupled to the target increases the likelihood that the stimulus signal will be delivered through target tissue thereby interfering with locomotion of the target.

A processing circuit in cooperation with a signal generator, zero or more detectors, and/or any other circuit of the CEW may determine a likelihood that an electrode is electrically coupled to a target. Detecting whether an electrode is electrically coupled to a target is a challenging problem. Generally, the environment in which a CEW is used may be chaotic, unpredictable, and/or dynamic. Electrodes may land on various types of material in the surroundings, other than targets, that may or may not be conductive. Targets may wear clothing and/or accessories (e.g., jewelry, watches, belt buckles, etc.) that interfere with determining connectivity. Electrodes may strike two or more targets. An electrode may couple to a target or be decoupled from a target due to motion of the target, the user of the CEW, and/or a third person thereby making connectivity change dynamically. However, a processing circuit may collect or receive information that aids the processing circuit in determining whether an electrode is electrically coupled to a target. The information and method used by a processing circuit, according to various aspects of the present disclosure, permits the processing circuit to detect connectivity of electrodes to targets with a high degree certainty.

In an implementation, a processing circuit collects and/or receives the information identified in Table 2 to determine whether an electrode is electrically coupled to a target. A processing circuit may use the below information to determine the quality of a connection of a pair of electrodes to a target. A connection may be quantified as "good" or "bad" as described in further detail below.

TABLE 2

Information Used to Determine Connectivity

| | Description of Information | Boolean Test Criteria |
|---|---|---|
| 1. | The portion of the charge of a pulse of the stimulus signal that flowed through the selected connection; | Pulse through selected connection? |
| 2. | Whether the pulse arced between terminals on the CEW; and | Pulse did not arc? |
| 3. | Whether the signal generator provided charge of the lower voltage portion of the pulse. | Charge provided? |

With reference again to FIG. 1, detector 122, detector 124, detector 126, and signal generator 120 cooperate with processing circuit 118 to determine the connection through which the charge of a pulse flows. Detector 122 detects an amount of charge (e.g., 55 microcoulombs to 71 microcoulombs) provided by a pulse of the stimulus signal. Detector 122 detects the charge provided through all possible connections between the electrodes. Detector 122 detects the amount of charge provided regardless of the connection or connections through which the charge flowed. Detector 122 may detect the amount of charge provided by each pulse of a stimulus signal. Detector 122 may include any type of detector that detects a current, a voltage, and/or an amount of charge. Detector 122 may detect (e.g., measure, quantify) a voltage, detect a current, detect a current over time, and/or integrate a current over time to detect an amount of charge.

Detector 124 detects an amount of charge provided via one or more positive electrodes (e.g., electrodes 250, 260, with brief reference to FIGS. 3 and 4). Detector 126 detects an amount of charge provided via one or more negative electrodes (e.g., electrodes 260, 290, with brief reference to FIGS. 3 and 4). Detecting the amount of charge provided by the various electrodes provides information that the processing circuit may use to determine the amount of charge that flows in each connection (e.g., connections 410, 412, 420, 422, with brief reference to FIG. 4). Detector 124 and 126 may detect the amount of charge through the one or more electrodes provided by each pulse of a stimulus signal. Detector 124 and 126 may include any type of detector that detects a current, a voltage, and/or an amount of charge. Detector 124 and 126 may detect (e.g., measure, quantify) a voltage, detect a current, detect a current over time, and/or integrate a current over time to detect an amount of charge.

A selected connection is the connection selected by the processing circuit for providing a pulse of the stimulus signal. For example, and with reference again to FIGS. 1 and 4, processing circuit 118 may select electrodes 250 and 290, which is connection 412, to provide a pulse of the stimulus signal. To send the pulse of the current through the selected connection, processing circuit 118 controls signal generator 120 so that the higher voltage portion of the pulse is provided via electrodes 250 and 290. However, the lower voltage portion of the pulse may flow through connection 412 or possibly through other connections (e.g., connections 410, 420, 422).

It is possible that only a portion of the charge of the pulse flows through the selected connection and the remainder of the charge of the pulse flows through another connection. For example, processing circuit 118 may select connection 410 (e.g., electrodes 250 and 260) as the selected connection, yet because a connection exists between electrodes 250 and 290 that has a better determined quality (e.g., a "good" connection has a better determined quality than a "bad" connection, as discussed further herein), most of the charge from the lower voltage portion of the pulse flows through connection 412.

Detectors 122, 124, and 126 provide information to processing circuit 118 so that processing circuit 118 may determine the connections through which the charge of a pulse flows. Processing circuit 118 has sufficient information to determine the portion of the total charge of a pulse that flowed through each connection. Processing circuit 118 may then determine whether the charge flowed through the selected connection.

If the current flowed through the selected connection, then the Boolean expression "Pulse through selected connection?" evaluates to true. If the current flowed through a connection other than the selected connection, the Boolean expression evaluates to false. A processing circuit may use a threshold to determine whether the current flowed through the selected connection. For example, if seventy percent or more of the current of a pulse flowed through the selected connection, processing circuit 118 may determine (e.g., consider) that the charge flowed through the selected connection. If less than seventy percent of the current of a pulse flowed through the selected connection, then processing circuit 118 may determine that the charge of the pulse did not flow through the selected connection.

As discussed above, a CEW may include terminals. Terminals may be used to provide a local delivery. Terminals also provide an alternate path (e.g., connection, circuit), as opposed to a connection through electrodes, for the current of a stimulus signal to flow. When two or more path are available, a current will travel (e.g., flow along, flow through, traverse, etc.) the path of least resistance. If the electrodes of a deployment unit have been launched (e.g., electrodes 250 and 260), the current of a stimulus signal may travel either connection 410 or arc across (e.g., between) terminals 220 and 222. If the impedance of connection 410 is higher than the impedance of the air between terminals 220 and 222, then the current from a pulse of the stimulus signal will ionize the air in the gap between terminals 220 and 222 and flow between terminals 220 and 222. The same principle applies to electrodes 280 and 290 and terminals 224 and 226.

Generally, the impedance between electrodes positioned in or near target tissue is less than the impedance between terminals, so the stimulus signal will likely be delivered via deployed electrodes rather than the terminals. However, if the impedance between deployed electrodes is greater than the impedance between the terminals, the stimulus signal may arc across the terminals even though electrodes are deployed. The impedance between deployed electrodes may be higher than the impedance between terminals if one or more of the pair of electrodes are not positioned in or near target tissue (e.g., electrodes missed target, electrodes hit insulated material, high impedance between electrodes, etc.).

If no connection between electrodes presents a lower impedance than the impedance between two terminals, then the current from a pulse of the stimulus signal will arc between two of the terminals. Arcing between terminals is an indicator that may be used to determine whether two or more of the electrodes are electrically coupled to a target. Detecting arcing between terminals may be one factor in determining the connectivity of a connection between two electrodes of a CEW.

Detecting an arc between terminals may be accomplished in any manner. Detectors may be used that detect the flow of a current between the terminals, an impedance between terminals, a change in impedance between terminals, heat caused by ionization, a sound of ionization, light from ionization, or any other physical phenomena of ionization, flow of a current, a voltage, and/or impedance, and/or a change thereof.

For example, in an implementation a CEW includes a photodetector that detects the light of ionization. In another implementation, a detector detects a sound of ionization. In another implementation, a detector detects a flow of current via at least one terminal. A detector may report to a processing circuit. A detector may report the occurrence of an arc or the lack of occurrence of an arc.

A signal generator may provide information for detecting arcing between terminals of a CEW. A signal generator forms each pulse of a stimulus signal. A signal generator provides each pulse of a stimulus signal. A signal generator may provide information as to an amount of charge provided by a pulse and/or a magnitude of the voltage required to provide the pulse. The information provided by a signal generator may be used to determine an impedance of the path (e.g., connection) traveled by the pulse. The magnitude of the impedance may be used to determine whether the current of the pulse arced between two terminals. The magnitude of an impedance of a connection may correlate (e.g., fall on) a load line. A load line of current provided via terminals may be different from a load line of a current provided via launched electrodes. Determining the load line that corresponds to providing a pulse of the stimulus signal may provide information as to whether the pulse arc across terminals.

To produce a pulse of a stimulus signal, a signal generator may store energy for the pulse. Energy for a pulse may be stored on a capacitor. The signal generator may provide the high voltage portion of the pulse. In the event that none of the launched electrodes are electrically coupled to the target by contact (e.g., spear in contact with target tissue) and the high voltage portion of the pulse cannot ionize the air in the gap between the launched electrodes and the target (e.g., gap too long), the signal generator does not provide (e.g., release, discharge) the lower voltage portion of the pulse of the stimulus signal. A signal generator may provide information as to whether the lower voltage portion of the pulse was released.

Information regarding whether the lower voltage portion of a pulse was released may be used as a factor in determining the connectivity of the electrodes with the target. A processing circuit may receive such information from a signal generator. A processing circuit may use the information to determine whether one or more electrodes are electrically coupled to a target.

A processing circuit may control a signal generator while storing energy to provide a pulse. A processing circuit may determine a magnitude of a voltage on a capacitance used to provide the lower voltage portion of the pulse before the pulse is provided. A processing circuit may determine the voltage across the capacitance used to provide the lower voltage portion of the pulse after the higher voltage portion of the pulse has been provided. A processing circuit may determine the amount of charge on the capacitance before and after providing the high voltage portion of the pulse. A processing circuit may compare a change in a voltage of a capacitance to a threshold. A processing circuit may determine whether the signal generator provided a current in accordance with the threshold. For example, if the change of charge on a capacitance is less than a threshold, a processing circuit may determine that the signal generator did not provide a current. For example, if the change of charge on a capacitance is greater than or equal to a threshold, a processing circuit may determine that the signal generator did provide a current.

A processing circuit may use the information identified in Table 2 to determine whether an electrode is electrically coupled to a target. Using the information of Table 2 a processing circuit may assess the quality of a connection. The term "quality" when applied (e.g., referring) to a connection means the nature (e.g., property, grade, caliber, etc.) of the connection with respect to electrical connectivity and in particular electrical connectivity to a target. A connection defined as "good" means a closed connection (e.g., circuit) capable of delivering a pulse of current (e.g., a pulse of the stimulus signal). A "good" connection permits the flow of current through the connection. A "good" connection delivers the charge of a pulse of the stimulus signal through target tissue. A connection defined as "bad" means an open connection (e.g., circuit) or a high impedance circuit that inhibits flow of current through the connection. A "bad" connection will not deliver the charge of a pulse of the stimulus signal through target tissue.

In an implementation, the quality of a connection is defined as "good" (e.g., 1) or "bad" (e.g., 0). A good connection means that the electrodes that form the connection electrically couple to the target. A bad connection means that the electrodes that form the connection do not electrically couple to the target.

In an implementation, a processing circuit may select a connection for providing a pulse of a stimulus signal from the connections that are classified as good. A processing circuit may not select a connection for providing a pulse of the stimulus signal from the connections that are classified as bad. However, as discussed below, a processing circuit may select a connection for providing a pulse of the current from the connections that are classified as bad to test the connection to determine if the quality of the connection has changed. Accordingly, a processing circuit may select both good and bad connections for providing a pulse of the stimulus signal.

Providing a pulse via a connection does not mean that that pulse is delivered through the target because the quality of the connection may be bad. Providing a pulse to a connection means applying the voltage of the pulse to the selected connection. Whether the pulse is delivered through the target depends on the quality of the connection.

In an implementation, a processing circuit uses the test criteria from Table 2 to determine whether a connection is good or bad. The processing circuit evaluates the test criteria as a Boolean expression. If the result of the Boolean expression is true (e.g., 1), then the connection is defined as being good. If the result of the Boolean expression is false (e.g., 0), then the connection is defined as being bad. The Boolean expression for determining the quality of the connection is provided in Equation 10.

Connection=Pulse through selected connection? &
Pulse did not arc?& Charge provided? Equation 10:

For example, if the charge of a pulse flows through the selected connection AND the charge from the pulse does NOT arc between terminals AND the charge from the pulse is provided THEN the connection is defined as being good (e.g., connection=1). If any of the factors is found to be false (e.g., not true, 0), then the connection is bad (e.g., connection=0). For example, if a threshold amount of charge of the pulse did not flow through the selected connection OR if the charge of the pulse arced between terminals OR if the signal generator did not provide charge (e.g., amount of charge, microcoulombs, etc.) greater than a threshold THEN the connection is defined as being bad (e.g., connection=0).

Empirical testing has shown that these factors, as described with respect to an implementation below, determine with a high accuracy whether a connection (e.g., circuit) between two electrodes will provide a pulse of a stimulus signal through a target (e.g., good connection) or will not provide a pulse of a stimulus signal through a target (e.g., bad connection).

Using the above factors, a processing circuit (e.g., processing circuit 118) may determine the quality of connections 410, 412, 420, and 422. If only the electrodes of one deployment unit (e.g., deployment units 240 or 270) have been launched, the processing circuit may determine the quality of the connection between the two launched electrodes. If the electrodes of both deployment units have been launched, the processing circuit may test the quality of the connection between any positive electrode (e.g., electrodes 250, 280) and any negative electrode (e.g., electrodes 260, 290).

After a processing circuit has determined the quality of the various connections, the processing circuit may use the information to determine which connection or sequence of connections are the best for providing pulses to the target. A processing circuit may select the same or a different connection for each pulse of a stimulus signal. For example, assuming that all possible connections (e.g., connections 410, 412, 420, 422) are "good", processing circuit 118 may control signal generator 120 to send a first pulse of the stimulus signal through the target via connection 410, a second pulse via connection 412, a third pulse via connection 420, and a fourth pulse via connection 422. Further pulses may be sent via the connections in the same order (e.g., 410, 412, 420, 422, 410, 412, 420, 422, and so forth). The order of the connections that are used to send a pulse is referred to as a sequence or a sequence of connections (series of connections, ordered series of connections, list of connections, ordered list of connections, etc.).

A connection may appear zero or more times in a sequence. A sequence may be repeated indefinitely to provide pulses in accordance with the sequence.

Figure 5:
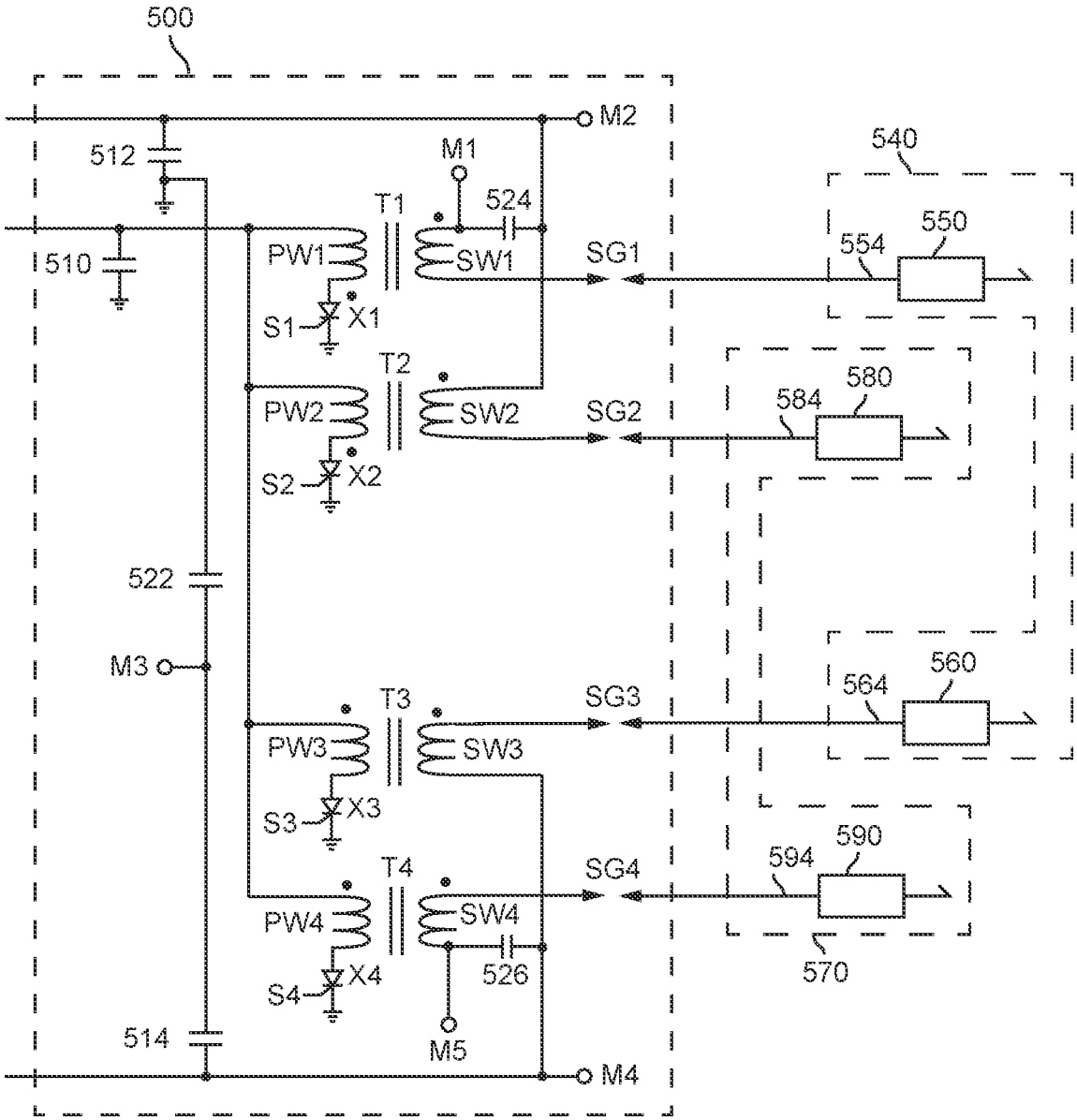
FIG. 5 is an implementation of the signal generator of FIG. 1.

An implementation of signal generator 120 is provided in FIG. 5 as a signal generator 500. Signal generator 500 performs the functions of a signal generator discussed above. Signal generator 500 includes capacitances 522, 524, and 526, which perform the functions of detectors 122, 124, and 126 respectively. A capacitance includes any structure and/or component that receives a charge, stores a charge, and provides (e.g., discharges) a charge. For example, a capacitor is one implementation of a capacitance.

Electrodes 550 and 560 perform the functions of an electrode and of electrodes 250 and 260 respectively discussed above. Electrodes 550 and 560 are packaged in the same deployment unit 540. Electrodes 580 and 590 perform the functions of an electrode and of electrodes 280 and 290 respectively discussed above. Electrodes 580 and 590 are packaged in the same deployment unit 570. Deployment units 540 and 570 perform the functions of a deployment unit and of deployment units 140 and 170 respectively discussed above. Filaments 554, 564, 584, and 594 couple electrodes 550, 560, 580, and 590 respectively to signal generator 500. Filaments 554, 564, 584, and 594 perform the functions of a filament and of filaments 154, 164, 184, and 194 respectively discussed above. Filaments 554, 564, 584, and 594 may couple to signal generator 500 via an interface.

Signal generator 500 includes capacitances 510, 512, and 514. To provide one pulse of a stimulus signal, capacitance 510 is charged to a positive voltage in the range of 100-1200 volts, for example. Capacitance 512 and 514 are each charged to a voltage in the range of 500-6,000 volts, for example. The polarity of the voltage on capacitance 510 and 512 is positive with respect to ground. The polarity of the voltage on capacitance 514 is negative with respect to ground.

Signal generator 500 may include one or more transformers, such as transformers T1, T2, T3, and T4. Each transformer of signal generator 500 includes a primary winding and a secondary winding respectively. For example, transformers T1, T2, T3, and T4 include primary windings PW1, PW2, PW3, and PW4 respectively and secondary windings SW1, SW2, SW3, and SW4 respectively. One end (e.g., a first end, an electrode connecting end, etc.) of each secondary winding couples to a respective electrode. The other end (e.g., a second end, a capacitance connecting end, etc.) of each secondary winding couples to a capacitance.

The primary winding of each transformer is coupled in series with a respective switch. For example, primary windings PW1, PW2, PW3, and PW4 are coupled in series with switches X1, X2, X3, and X4 respectively. Each switch controls the flow of a current from a capacitance through one or more of primary windings PW1, PW2, PW3, and PW4. Switches X1, X2, X3, and X4 include any conventional switches that are suitable for the magnitude of current and voltage associated with operation of signal generator 500. Switches X1, X2, X3, and X4 include any conventional switches that may be controlled (e.g., operated) by a processing circuit. Switches X1, X2, X3, and X4 are suitable for control by a signal (e.g., current; voltage; secondary windings S1, S2, S3, and S4; etc.) from a processing circuit (e.g., processing circuit 118, with brief reference to FIG. 1). Control by a switch may include starting (e.g., initiating) and/or stopping (e.g., interrupting) the flow of current through the switch. Controlling the flow of a current through switches X1, X2, X3, and X4, controls the flow of the current through primary windings PW1, PW2, PW3, and PW4 respectively. Accordingly, a processing circuit may control a flow of current through each primary winding of transformers T1, T2, T3, and T4. A processing circuit may enable the flow of a current through the primary winding of one or more transformers. A processing circuit may control signal generator 500 so that only one electrode is enabled to electrically couple with a target, a pair of electrodes are enabled to electrically couple to a target, or more.

In an implementation, switches X1, X2, X3, and X4 are silicon-controlled rectifiers ("SCR") (e.g., thyristor). Processing circuit 118 includes output ports that respectively couple to gates S1, S2, S3, and S4 of SCRs X1, X2, X3, and X4 respectively. Processing circuit 118 may apply a voltage on the gate of an SCR to start a flow of current from capacitance 510 through the SCR. The SRC that permits (e.g., enables) the flow of current is said to be enabled (e.g., closed, turned on).

A transformer is said to be selected, by a processing circuit, when the processing circuit enables the switch coupled to the primary winding of the transformer. Because the secondary winding of each transformer is coupled to only one electrode, selecting a transformer also means selecting the electrode coupled to the transformer. A processing circuit may select two or more transformers to provide a pulse of the stimulus signal through the electrodes coupled to the selected transformers.

In signal generator 500, providing a current through the primary winding of transformers T1, T2, T3, and/or T4 causes a current to flow in the secondary winding of the same transformer. In this implementation, the current provided to the primary winding of a transformer is provided at a lower voltage (e.g., 100-1200 volts, etc.) and the current provided by the secondary winding is provided at a higher voltage (e.g., 40,000-100,000 volts, etc.). The higher voltage provided by the secondary windings of the selected transformers is the higher voltage portion of a pulse of the stimulus signal discussed above.

The higher voltage ionizes the spark gap (e.g., spark gaps SG1, SG2, SG3, SG4) in series with the secondary winding so that the higher voltage from the secondary winding is impressed on the electrode coupled to the secondary winding. The higher voltage impressed on the electrode may ionize air in a gap between the electrode and the target to electrically couple the electrode to the target. Because it is the voltage across capacitance 510 that provides the energy to ionize between the electrode and the target, capacitance 510 may be referred to as the spark capacitance or ionization capacitance.

Ionizing the spark gap in series with a secondary winding of a transformer (e.g., spark gaps SG1, SG2, SG3, SG3) electrically couples capacitance 512 and capacitance 514 to the electrodes coupled to the respective secondary windings. Coupling capacitances 512 and 513 to electrodes provides the lower voltage portion of a pulse of the stimulus signal. As discussed above, the majority of the charge provided by a pulse of a stimulus signal is provided during the lower voltage portion of the pulse. Capacitances 512 and 514 may be referred to as the muscle capacitances because they provide the charge that interferes with the skeletal muscles of the target or causes pain.

The above discussion with respect to providing the higher voltage and lower voltage portions of the pulse to electrodes also applies to terminals. If the impedance of the circuit via electrodes is higher than the impedance between terminals, the higher voltage portion ionizes between terminals and the lower voltage portion is provided via the ionization path between terminals or through a target for a local stun.

Capacitance 512 stores and provides a current at a voltage (e.g., 500-6,000 volts, etc.) that has a positive polarity with respect to ground. Because the current from capacitance 512 may flow through electrodes 550 and/or 580, electrodes 550 and 580 provide a current at a voltage that has a positive polarity. Electrodes 550 and 580 may be referred to as positive electrodes. Capacitance 514 stores and provides a current at a voltage (e.g., 500-6,000 volts, etc.) that has a negative polarity with respect to ground. Because the current from capacitance 514 may flow through electrodes 560 and/or 590, electrodes 560 and 590 provide a current at a voltage that has a negative polarity. Electrodes 560 and 590 may be referred to as negative electrodes.

If an electrode is in contact with target tissue, the high voltage portion of the pulse is not needed to ionize air in a gap to electrically couple the electrode to the target. The high voltage across the secondary winding of the enabled transformer ionizes the spark gap in series with the secondary winding so that capacitance 512 and capacitance 514 may deliver their charge through the target.

To provide a pulse of the stimulus signal through a target, processing circuit 118 selects one positive electrode and one negative electrode to provide the pulse. Processing circuit 118 selects electrodes by selecting the transformer whose secondary winding is coupled to the electrode. To send a pulse of the current from signal generator 500 to the target via two electrodes, processing circuit 118 selects one transformer of transformers T1 and T2 and one transformer of transformer T3 and T4. For example, selecting transformer T1 selects electrode 550, selecting transformer T2 selects electrode 580, etc. Table 3 identifies the transformers that are selected to provide a pulse of the current via the connections discussed above, with reference to FIGS. 4 and 5.

TABLE 3

Transformer Selection by Connection

| | Positive | | Negative | |
|---|---|---|---|---|
| Connection | Transformer | Electrode | Transformer | Electrode |
| 410 | T1 | 550 | T3 | 560 |
| 412 | T1 | 550 | T4 | 590 |
| 420 | T2 | 580 | T4 | 590 |
| 422 | T2 | 580 | T3 | 560 |

In operation, signal generator 500 forms a pulse of current that may be delivered by selected transformers, and in turn by selected electrodes, through target tissue to impede locomotion of the target. Signal generator 500 may be operated repeatedly (e.g., 11-50 pps, etc.) for a period of time (e.g., 5-30 seconds, etc.) to produce a series of current pulses at a pulse rate to form a stimulus signal to impede locomotion of a target as discussed above.

Prior to providing a pulse of current, transformers T1, T2, T3, and T4 are preferably in a quiescent state in which the current flow in the primary and secondary windings is negligible and the voltage across the secondary has subsided sufficiently for the ionization path through the spark gaps SG1, SG2, SG3, and SG4 to collapse (e.g., terminate, cease, etc.).

Providing a pulse of the stimulus signal via a connection does not necessarily mean that the charge of the pulse is delivered via the connection through the target. Applying the pulse means charging capacitances 510, 512, and 514, selecting the transformers and in turn the electrodes of the connection then releasing the charge stored on capacitance 510 into the primary winding of the selected transformers. If the selected electrodes electrically couple to the target, then the charge of the pulse may be delivered via the connection. If the electrodes are not electrically coupled to the target, then the charge of the pulse may not flow through the target tissue.

As discussed herein, providing a pulse to a connection provides processing circuit 118 the opportunity to assess the quality of the connection. Processing circuit 118 may provide a pulse of the stimulus signal to a connection that has been classified as bad to determine whether the quality of the connection has changed. Signal generator 500 may provide processing circuit 118 information to determine the quality of the connection as discussed below.

The process of providing a pulse of stimulus signal may also be used to determine the quality of the selected connection. The components of signal generator 500 cooperate with processing circuit 118 to detect the three criteria of Table 2 for determining the quality of a connection. Information provided by signal generator 500 to processing circuit 118 enables processing circuit 118 to determine the validity of the three terms of the Boolean expression in Equation 10.

Capacitances 522, 524, and 526 provide information so processing circuit 118 may determine the value of the term "Pulse through selected connection?" of the Boolean expression in Equation 10. Capacitances 522, 524, and 526 perform the functions of a detector discussed above. Capacitances 522, 524, and 526 perform the functions of detector 122, 124, and 126 discussed above.

Prior to providing a pulse of the current, capacitances 522, 524, and 526 are discharged so that they hold no charge and the voltage across the capacitances is zero.

When signal generator 500 provides a pulse of the stimulus signal, the charge of the pulse, regardless of the path (e.g., connections 410, 412, 420, 422, with brief reference to FIG. 4) traveled, flows through and is accumulated by capacitance 522. Prior to providing a pulse, the voltage across capacitance 522 is zero. After providing a pulse, the voltage across capacitance 522 may be measured with respect to ground. Processing circuit 118 may measure the voltage at measurement point M3 to detect the voltage across capacitance 522. Processing circuit 118 may monitor (e.g., periodically detect, periodically measure) the voltage across capacitance 522 during or after provision of a pulse. Processing circuit 118 may integrate the amount of current that flows through capacitance 522 to determine an amount of charge stored by capacitance 522.

Processing circuit 118 may determine an amount of charge present on capacitance 522. When provision of a pulse is complete, the amount of charge on capacitance 522 represents the total amount of charge provided by the pulse. As discussed above, the amount of charge provided by a pulse may be in the range of 55 microcoulombs to 71 microcoulombs, for example.

When signal generator 500 provides a pulse of the current, the charge of the pulse that flows through electrode 550 flows through and is accumulated by capacitance 524. Prior to providing a pulse, the voltage across capacitance 524 is zero. After or during provision of the pulse, the voltage across capacitance 524 and/or current through capacitance 524 may be measured by processing circuit 118 between measurement points M1 and M2. Processing circuit 118 may measure and/or monitor the voltage and/or current at measurement points M1 and M2. Processing circuit 118 may determine an amount of charge present on capacitance 524.

When signal generator 500 provides a pulse of the current, the charge of the pulse that flows through electrode 590 flows through and is accumulated by capacitance 526. Prior to providing a pulse, the voltage across capacitance 526 is zero. After or during providing the pulse, the voltage across capacitance 526 and/or current through capacitance 526 may be measured by processing circuit 118 between measurement points M4 and M5. Processing circuit 118 may measure and/or monitor the voltage and/or current at measurement points M4 and M5. Processing circuit 118 may determine an amount of charge present on capacitance 526.

When provision of a pulse is complete, the amount of charge on capacitance 524 and 526 represents the amount of charge that flowed through electrode 550 and electrode 590 respectively. A capacitance similar to capacitance 524 and 526 could be placed in series with the secondary winding of transformer T2 and T3 respectively to detect the amount of charge that flowed through electrode 580 and 560 respectively; however, because transformers T1 and T2 deliver the charge to the positive electrodes and transformers T3 and T4 deliver the charge to the negative electrodes, the portion of the total charge that does not flow through electrode 550 flows through electrode 580 and the portion of the charge that does not flow through electrode 590 flows through electrode 560. Accordingly, the amount of charge that flows through each electrode 550 and 590 is measured directly using capacitance 524 and capacitance 526 respectively. The amount of charge that flows through electrode 580 may be calculated by subtracting the amount of charge that flows through electrode 550 from the total amount of charge as measured by capacitance 522. The amount of charge that flows through electrode 560 may be calculated by subtracting the amount of charge that flows through electrode 590 from the total amount of charge as measured by capacitance 522.

Figure 8:
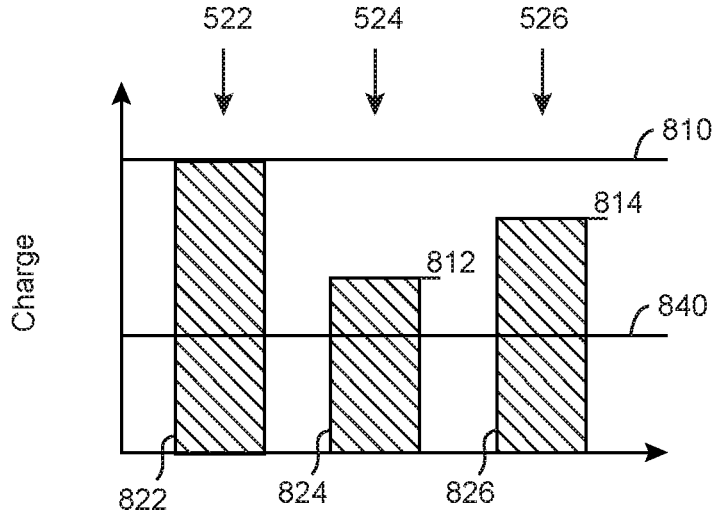
FIGS. 8-9 are diagrams of determining a connection of charge flow from a pulse of a stimulus signal.
Figure 9:
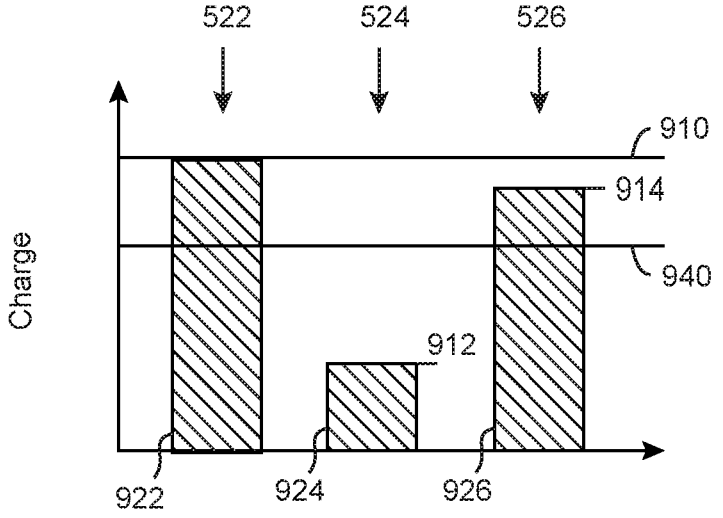

For example, referring to FIGS. 8 and 9, a charge 822 is the charge accumulated (e.g., captured) on capacitance 522 from delivery of one pulse of a stimulus signal. An amount of charge 810 of charge 822 represents the amount of charge (e.g., 63 microcoulombs, etc.) provided by the pulse. Charges 824 and 826 are the charges accumulated on capacitances 524 and 526 respectively from delivery of the one pulse of current. An amount of charge 812 represents the amount of charge that flowed through electrode 550. An amount of charge 814 represents the amount of charge that flowed through electrode 590. Amount of charge 812 and amount of charge 814 are a portion (e.g., 0%-100%) of amount of charge 810. Amount of charge 812 is less than amount of charge 810. The entire amount of charge 810 flows through positive electrodes 550 and 580, so since amount of charge 812 flowed through electrode 550, the difference between amount of charge 810 and amount of charge 812 (e.g., amount of charge 810–amount of charge 812) flowed through electrode 580.

The same analysis applies to the charge that flows through negative electrodes 560 and 590. The full amount of charge 810 also flows through the negative electrodes 560 and 590. Since amount of charge 814 flowed through electrode 590, the difference between amount of charge 810 and amount of charge 814 (e.g., amount of charge 810–amount of charge 814) flowed through electrode 560.

Processing circuit 118 may use information provided by capacitance 522, 524, and 526 to determine whether the circuit (e.g., connections 410, 412, 420, 422) selected to provide the charge of the pulse actually provided the charge. Depending on the connectivity of the electrodes, assuming that all four electrodes 550, 560, 580, and 590 have been launched, some amount of the charge of the pulse may flow in connections that have not been selected. Processing circuit 118 may analyze the charge information from capacitances 522, 524, and 526 and use a threshold to determine the connection through which the charge flowed.

The threshold may be related to the amount of charge provided by the pulse. A threshold may be related to the ratio of the amount of charge that flowed through a connection and the amount of charge provided by the pulse (e.g., amount 812/amount 810, amount 814/amount 810, etc.). A threshold may be defined as a portion (e.g., 25%, 51%, 75%, etc.) of the charge provided by a pulse (e.g., amount 810).

For example, referring to FIG. 8, processing circuit 118 uses threshold 840 to determine the connection of charge flow. Since amount of charge 812 is greater than threshold 840, processing circuit 118 determines that the charge from the pulse flowed through electrode 550, even though some of the charge also flowed through electrode 580. Since amount of charge 814 is greater than threshold 840, processing circuit 118 determines that the charge from the pulse flowed through electrode 590, even though some of the charge also flowed through electrode 560. The determination that the charge of the pulse flowed through electrodes 550 and 590 means that the charge of the pulse flowed through connection 412. In this example, the threshold 840 may be defined as 51% of the amount of charge 810.

If processing circuit 118 selected transformer T1 (e.g., by enabling signal S1) and transformer T4 (e.g., by enabling signal S4) to provide the pulse then the selected connection, connection 412, is the same as the connection of actual charge flow, as determined above, so the pulse was provided through the selected connection. In this case the Boolean expression "Pulse through selected connection?" is true. If processing circuit selected connection 410 (e.g., transformer T1 and transformer T3) to provide the pulse, then the selected connection would not be the same as the connection of actual charge flow, so the term "Pulse through selected connection?" of the Boolean expression would be false.

The threshold for determining the electrode of actual charge flow may be set to any value, but is preferably defined as greater than 50% of the amount of charge accumulated by capacitance 522 (e.g., charges 810, 910). With reference to FIG. 9, and continued reference to FIGS. 4 and 5, threshold 940 is a greater proportion of the charge of a pulse than the portion set by threshold 840 (with brief reference to FIG. 8). Because amount of charge 912 is less than threshold 940, processing circuit 118 determines that the actual flow of charge was through electrode 580. Because the amount of charge 914 is greater than the threshold, processing circuit 118 determines that the actual flow of charge was through electrode 590. Because the charge flowed through electrodes 580 and 590, the connection of actual charge flow is connection 420. Processing circuit 118 may compare the connection selected to provide the charge from the pulse to the connection of actual charge flow to determine whether the term "Pulse through selected connection?" of the Boolean expression is true or false.

Signal generator 500 may provide information so that processing circuit 118 may determine the value of the term "Pulse did not arc?" of the Boolean expression in Equation 10.

The impedance through target tissue is different from the impedance between two terminals. Processing circuit 118 may monitor the voltage across capacitance 522, at measuring point M3, and the charge accumulated on capacitance 522 to determine an amount of charge delivered from capacitance 522 and a change in voltage across capacitance 522. Processing circuit 118 may use the information from signal generator 500 to determine (e.g., measure) a load line of the load coupled to the electrodes of a connection. Processing circuit 118 may compare the measured load line to load lines determined either theoretically and/or through empirical testing to determine whether the pulse arced between terminals or was delivered through a target. If the measured load line corresponds to the load line of delivery through target tissue, then processing circuit 118 determines that the pulse did not arc between terminals. If the measured load line corresponds to the load line of an arc between terminals, then processing circuit 118 determines that the pulse did arc between terminals.

Figure 10:
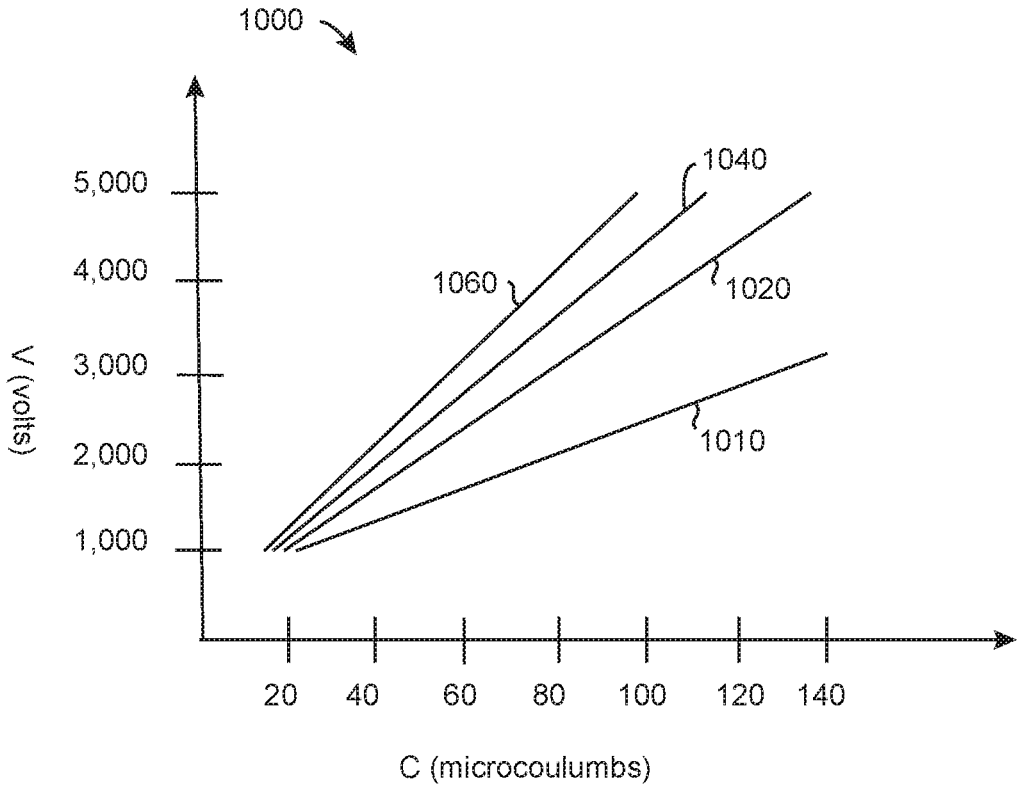
FIG. 10 is a diagram of load lines used to determine whether a pulse of the stimulus signal arced across terminals on the CEW.

For example, FIG. 10 depicts a graph 1000 that presents load lines 1010, 1020, 1040, and 1060 that are based on empirical data. Load lines 1020, 1040, and 1060 correspond to providing a pulse of the stimulus signal through target tissue having an impedance of 250 ohms, 400 ohms, and 600 ohms, respectively. Load line 1010 corresponds to the load line when a pulse of the stimulus signal arcs between two terminals.

The y-axis of graph 1000 of FIG. 10 represents the voltage across one or both muscle capacitances 512 and 514 (with brief reference to FIG. 5). The x-axis of graph 1000 represents the amount of charge provided by one or both muscle capacitances 512 and 514. Because change is equal to an amount of current for a duration of time, the x-axis of the graph represents the amount of charge provided by one or more muscle capacitances over time (e.g., the duration of a pulse). Measuring the voltage across one or both muscles capacitances provides the voltage shown in the y-axis. Measuring an amount of charge provided by (e.g., discharged from) one or both muscle capacitances provides the amount of charge shown in the x-axis.

For example, the voltage across capacitance 512 after charging may be measured at 3000 volts. The amount of charge provided by capacitance 512 when discharged may be about 73 microcoulombs (wherein "about" as used in this sentence refers only to +/−5 microcoulombs). The intersection of 3000 volts and 72 microcoulombs lies on load line 1040, which indicates that the current was provided through a target having an impedance of about 400 ohms (wherein "about" as used in this sentence refers only to +/−25 ohms). The measured voltage and the charge provided does not correspond to load line 1010, which provides further evidence that the charge was delivered through a target and did not arc between terminals.

If the load line information measured by processing circuit 118 corresponds to load line 1020, 1040, or 1060, then processing circuit 118 determines that the term "Pulse did not arc?" of the Boolean expression in Equation 10 is true. If the load line information measured by processing circuit 118 corresponds to load line 1010, then processing circuit 118 determines that the term "Pulse did not arc?" of the Boolean expression in Equation 10 is false.

The data of empirically measured load lines 1010, 1020, 1040, and 1060 may be stored in memory 116 for access by processing circuit 118 for comparison to the measure load line. Load line information may be stored in memory 116 in any format and/or any manner of organization. Memory 116 may further store data needed by processing circuit 118 to generate theoretical load lines if needed. Memory 116 may also store theoretical load line information, so that it does not need to be generated prior to use by processing circuit 118. For example, the theoretical load line information may be generated using a historical analysis, models, or the like, and may be transmitted to and stored in memory 116.

Signal generator 500 may provide information so that processing circuit 118 may determine the value of the term "Charge provided?" of the Boolean expression in Equation 10.

Processing circuit 118 may monitor the voltage across capacitance 512, at measuring point M2, and/or the voltage across capacitance 514, at measuring point M4, before and after providing a pulse to determine whether any charge was provided by signal generator 500.

As discussed above, prior to providing one pulse of a stimulus signal, capacitance 510 is charged to a positive voltage, capacitance 512 is charge to a positive voltage, and capacitance 514 is charged to a negative voltage. To provide (e.g., release, discharge) the pulse, processing circuit 118 enables the switch (e.g., switches S1, S2) of one of transformer T1 and T2 and the switch (e.g., switches S3, S4) to one of transformer T3 and T4. Enabling a switch opens the switch (e.g., switches X1, X2, X3, X4) so that the charge from capacitance 510 discharges through the primary windings (e.g., primary windings PW1, PW2, PW3, PW4) of the of the selected transformers. The charge from capacitance 510 causes a high voltage to develop on the secondary winding (e.g., secondary windings SW1, SW2, SW3, SW4) of the selected transformers. The high voltage on the secondary winding ionizes the spark gap (e.g., spark gaps SG1, SG2, SG3, 5G4) attached to the secondary winding of the selected transformers to couple the secondary windings to an electrode (e.g., electrodes 550, 560, 580, 590).

Ionization of the spark gap electrically couples capacitance 512 and capacitance 514 to the electrodes of the selected transformers. However, if there is no electrical connection between the selected electrodes and the pulse does not arc between terminals, then little or no charge is discharged from capacitance 512 and capacitance 514.

Processing circuit 118 may measure the magnitude of the voltage on capacitance 512 and/or capacitance 514 after they are charged to provide a pulse. Processing circuit 118 may start provision of the pulse by enabling the switches (e.g., switches X1, X2, X3, X4) of the selected transformers. After sufficient time for delivery of the pulse, processing circuit 118 may again measure the magnitude of the voltage on capacitance 512 and/or capacitance 514.

If the magnitude of the voltage across capacitance 512 and/or capacitance 514 has changed less than a threshold, processing circuit 118 determines that the term "Charge provided" of the Boolean expression of Equation 10 is false. If the magnitude of the voltage across capacitance 512 and/or capacitance 514 has changed a threshold or more than the threshold, processing circuit 118 determines that the term "Charge provided" of the Boolean expression of Equation 10 is true.

In an implementation, the threshold used by processing circuit 118 to determine the value of the term "Charge provided" is about 10 percent of the initial magnitude of the voltage across capacitance 512 or capacitance 514 (wherein "about" as used in this sentence refers only to +/−2 percent). A threshold may be in the range of 5 to 60 percent of the initial magnitude of the voltage across capacitance 512 and/or capacitance 514.

As discussed above, each time signal generator 500 provides a pulse of the stimulus signal, processing circuit 118 may determine the quality of the connection for providing the pulse. As further discussed above, CEWs may be used in dynamic situations where the connectivity of electrodes may rapidly change. As a result, processing circuit 118 may determine the quality of the selected connection each time a pulse of the stimulus signal is provided. Processing circuit 118 may maintain a record of the quality of a connection, the values of Equation 10 determined for a connection, whether a connection is determined to be "good" or "bad," and/or any other related connection data.

Processing circuit 118 may use the information regarding the quality of the connections to provide pulses between the various connections to increase the likelihood of impeding target locomotion and/or to test the quality of the connection.

As discussed above, the likelihood of inducing NMI increases when each pulse of a stimulus signal delivers an amount of charge in the range of 55 microcoulombs to 71 microcoulombs per pulse and the pulses are delivered at a rate between 11 pulses per second ("pps") and 50 pps. In an implementation, each pulse provides 63 microcoulombs of charge and is delivered at a rate of between 11 pps and 22 pps.

If a processing circuit provides too many pulses of a stimulus signal to connections that have bad quality, the rate of pulses per second that actually deliver charge through target tissue may be too low to induce NMI. If the processing circuit delivers too may pulses to connections that have good quality, the amount of current actually delivered through target tissue may be more than is needed to induce NMI thereby wasting energy. If the processing circuit delivers too few pulses to connections that are categorized as having bad quality, the processing circuit may not detect that the quality of the connection has changed from bad to good thereby establishing an additional connection for providing pulses.

A processing circuit may balance the factors of providing change per pulse and pulses per second to induce NMI without wasting energy or not detecting a change in the quality of a connection by using one or more sequences of connections to provide pulses of the stimulus signal. A sequence of connections is a sequential order of connections for providing pulses of the stimulus signal. A sequence specifies a first connection for providing one pulse of the stimulus signal, followed by a next connection (e.g., a second connection) for providing a next pulse, followed by a next connection (e.g., a third connection) for a next pulse, and so forth.

Since pulses of a stimulus signal are provided for a period of time (e.g., 5 seconds), the order identified by a sequence may need to be repeated two or more times to provide pulses for the period of time. A sequence may be determined and/or selected in accordance with the present quality of the connections. If the quality of one or more connections changes, the sequence for providing pulses of the stimulus signal may also change in accordance with the updated quality of connections.

Providing pulses of the stimulus signal in accordance with a sequence establishes the pulses per second that are provided via each connection.

amount of power used. Assume for the sequences provided in Table 4 for a pulse rate of 50 pps that each pulse provides between 50-60 microcoulombs of current which is in the range for inducing NMI, but at the lower end of the range to save power since the pulse rate is 50 pps.

In Table 4, a connection quality of "1" refers to a good connection according to the criteria discussed above and in Equation 10. A connection of "0" refers to a bad connection according to the criteria discussed above and in Equation 10. The number of pulses per connection refers to the number of times the signal generator provides a pulse and not necessarily, especially via a bad connection, the number of pulses per second delivered through a target. The number of pulses delivered to a connection may be a fractional value because that is the number of pulses provided by that connection when the sequence is repeated for one second.

In Table 4, the signal generator provides a pulse to each connection of a sequence in sequential order. The signal generator provides one pulse to the first connection, one pulse to the next connection, and so forth. When the last connection of a sequence is reached, operation loops back to the first connection of the sequence to continue providing pulses. Pulses are sent in accordance with the sequence until the period of time (e.g., 5 seconds) is reached or a connection changes quality so that a new sequence may be selected for providing pulses.

In Table 4, the numbers 410, 412, 420, and 422 refer to connections 410, 412, 420, and 422 shown in FIG. 4 and discussed herein. Sequences may be developed for a CEW with any number of connections.

TABLE 4

Connection Sequences and Resulting PPS per Connection

| Connection Quality | | | | Connection Sequence | | | | | | | | Resulting PPS | | | |
|---|---|---|---|---|---|---|---|---|---|---|---|---|---|---|---|
| 422 | 420 | 412 | 410 | 1 | 2 | 3 | 4 | 5 | 6 | 7 | 8 | 422 | 420 | 412 | 410 |
| 0 | 0 | 0 | 0 | 422 | 420 | 412 | 410 | | | | | 12.5 | 12.5 | 12.5 | 12.5 |
| 0 | 0 | 0 | 1 | 410 | 422 | 410 | 420 | 410 | 412 | 422 | | 14.3 | 7.1 | 7.1 | 21.4 |
| 0 | 0 | 1 | 0 | 412 | 422 | 412 | 420 | 412 | 410 | 422 | | 14.3 | 7.1 | 21.4 | 7.1 |
| 0 | 0 | 1 | 1 | 410 | 412 | 422 | 410 | 412 | 420 | 410 | 412 | 6.3 | 6.3 | 18.9 | 18.9 |
| 0 | 1 | 0 | 0 | 420 | 422 | 420 | 412 | 420 | 410 | 422 | | 14.3 | 21.4 | 7.1 | 7.1 |
| 0 | 1 | 0 | 1 | 410 | 420 | 422 | 410 | 420 | 412 | 410 | 420 | 6.3 | 18.9 | 6.3 | 18.9 |
| 0 | 1 | 1 | 0 | 412 | 420 | 422 | 412 | 420 | 410 | 412 | 420 | 6.3 | 18.8 | 18.8 | 6.3 |
| 0 | 1 | 1 | 1 | 410 | 412 | 420 | 422 | 410 | 412 | 420 | | 7.1 | 14.3 | 14.3 | 14.3 |
| 1 | 0 | 0 | 0 | 422 | 420 | 422 | 412 | 422 | 410 | 420 | | 21.4 | 14.3 | 7.1 | 7.1 |
| 1 | 0 | 0 | 1 | 410 | 422 | 412 | 410 | 422 | 420 | 410 | 422 | 18.8 | 6.3 | 6.3 | 18.8 |
| 1 | 0 | 1 | 0 | 412 | 422 | 420 | 412 | 422 | 410 | 412 | 422 | 18.8 | 6.3 | 18.8 | 6.3 |
| 1 | 0 | 1 | 1 | 410 | 412 | 422 | 420 | 410 | 412 | 422 | | 14.3 | 7.1 | 14.3 | 14.3 |
| 1 | 1 | 0 | 0 | 412 | 422 | 410 | 412 | 422 | 412 | 412 | 422 | 18.8 | 18.8 | 6.3 | 6.3 |
| 1 | 1 | 0 | 1 | 410 | 420 | 422 | 412 | 410 | 420 | 422 | | 14.3 | 14.3 | 7.1 | 14.3 |
| 1 | 1 | 1 | 0 | 412 | 420 | 422 | 410 | 412 | 420 | 422 | | 14.3 | 14.3 | 14.3 | 7.1 |
| 1 | 1 | 1 | 1 | 422 | 420 | 412 | 410 | | | | | 12.5 | 12.5 | 12.5 | 12.5 |

When a pulse is provided via a connection, whether good or bad, the processing circuit selects the transformers for providing the pulse, which selects the electrodes for providing the pulse, which selects the connection for providing the pulse. The pulse is then provided to the connection as discussed above. Whether the charge of the pulse is actually delivered through target tissue may depend on the quality of the selected connection.

For example, Table 4 below provides a possible sequence of connections for delivering or attempting delivery of pulses in accordance with the quality of the connections. The number of pulses per second per connection is limited to 22 pps to increase the likelihood of inducing NMI, and reduce the amount of power used. The number of pulses per second provided by all connections is limited to 50 pps to reduce the To illustrate the information in Table 4, assume that that the connection quality for all connections (e.g., connections 410, 412, 420, 422) is bad (e.g., see row 0000). The connection sequence when all connections have a bad quality is connection 422, connection 420, connection 412, and connection 410, which is a sequence of four connections. This example assumes that all four electrodes (e.g., electrodes 550, 560, 580, 590) have been launched. When processing circuit 118 and signal generator 120 provide pulses in accordance with row 0000, processing circuit 118 selects connection 422 (e.g., electrodes 280 and 260) and signal generator 120 provides one pulse to connection 422. Because connection 422 is bad, it is unlikely that the pulse will pass through target tissue; however, each time signal generator 120 provides a pulse, processing circuit 118 tests the connection, as discussed above, to determine whether its quality of the connection has changed. In this case, the quality of connection 422 may change to have good quality.

After the pulse has been provided on connection 422, processing circuit 118 selects connection 420 and signal generator 120 provides one pulse. While signal generator 120 provides the pulse, processing circuit 118 tests the quality of the connection. After the pulse has been provided on connection 420, connection 412 is selected. One pulse is provided through connection 412 while the connection is tested. After the pulse on connection 412 has been provided, connection 410 is selected and one pulse provided while also testing the connection. After providing a pulse on connection 410, if the period of time (e.g., 5 seconds) for providing the stimulus signal has not lapsed, the sequence is repeated by selecting connection 422, sending one pulse while testing, selecting connection 420, sending a pulse while testing, and so forth repeating the sequence until the period of time has lapsed.

The sequences establish a maximum rate for a good connection and a total rate for all connections. A maximum rate for a good connection may be set to provide pulses of the stimulus current at a rate that is likely to induce NMI without providing too much charge so that power is wasted by providing more energy than might be needed to induce NMI. A maximum pulse rate per a good connection may be in the range of 11 pps to 50 pps. In Table 4, the maximum pulse rate provided to a good connection is 22 pps (e.g., see row 0001 connection 410, row 0010 connection 412, row 0100 connection 420, row 1000 connection 422). In another implementation, the maximum pulse rate provided to a good connection is 11 pps. In another implementation, the maximum pulse rate provided to a good connection is 44 pps.

A total rate for all connections may be set to provide pulses to multiple good connections to increase the likelihood of inducing NMI while not using more energy than is needed to induce NMI and to perform testing of bad connections. A quality of a connection may change when a target falls over and moves an electrode so that it is electrically coupled to the target. Connections should be tested with reasonable frequency to detect the change of quality from bad to good, and vice versa, for a connection. Since a six-foot-tall person takes about 0.6 seconds to fall over, checking a connection at least every 0.6 seconds should detect a change in quality almost as soon as it happens (wherein "about" as used in this sentence refers only to +/−0.2 seconds). In Table 4, the maximum pulse rate for all connections is set to 50 pps (e.g., sum of all pulse rates for any one row is equal to about 50 pps). In another implementation, the maximum rate for all connections is 44 pps. In another implementation, the maximum rate for all connections is about 48 pps (wherein "about" as used in this sentence refers only to +/−3 pps). A total rate for all connections may be in the range of 22 pps and 50 pps.

The minimum pulse rate of a CEW should be equal to or greater than the rate at which the CEW provides pulses to all connections. If a maximum pulse rate provided to all connections is 55 pps, the CEW needs to provide at least 55 pps. If a maximum pulse rate for all connections, such as in Table 4 above, is 50 pps, the CEW needs to provide at least 50 pps. A CEW may be capable of providing pulses at a rate higher than the maximum rate for all connections; however, some pulses would not be provided to connections to maintain the maximum pulse rate for all connections. For example, a CEW capable of producing 100 pulses per second would only provide 50 of its pulses per second to connections to maintain a maximum pulse rate to all connections of 50 pps.

For all sequences discussed above, the amount of charge provided per pulse may be in the range of 55 microcoulombs to 71 microcoulombs. In an implementation, the charge per pulse is 63 microcoulombs per pulse.

The sequence of connections for a maximum rate per good connection and maximum rate for all connections will likely be different than the sequences for a different maximum rate per good connection and maximum rate for all connections. For example, for an implementation that has a maximum rate per a good connection of 22 pps and a maximum rate for all connections of 44 pps, a possible sequence for row 0101 is connections 420, 410, 420, 410, 412, 420, 410, 420, 410, 422, which provides pulses at a rate of 4.4 pps, 17.6 pps, 4.4 pps, and 17.6 pps to connections 422, 420, 412, and 410 respectively.

Figure 11:
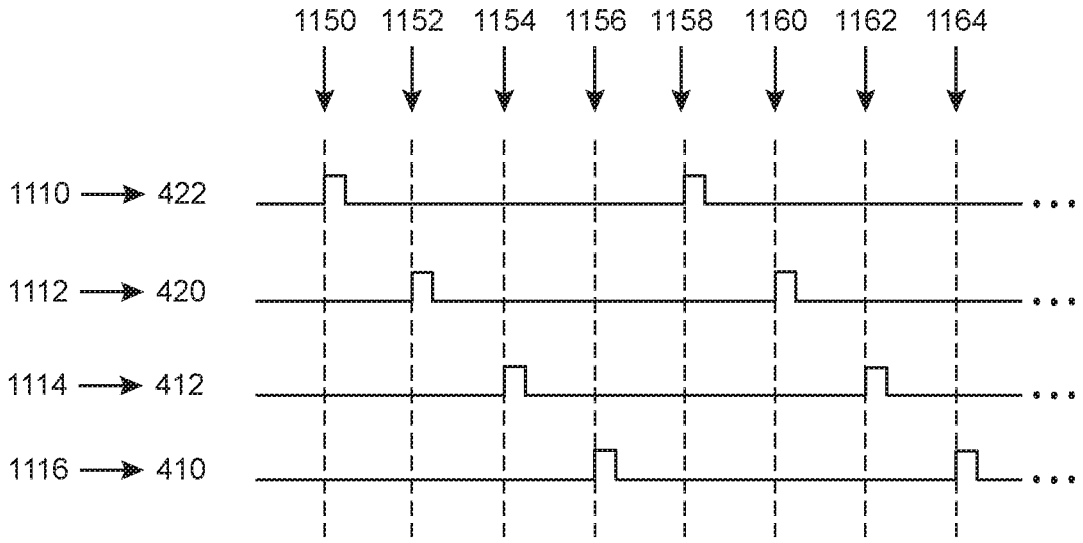
FIGS. 11-12 are diagrams of pulses of a stimulus signal provided in accordance with a sequence of connections.

The diagram of FIG. 11 depicts a sequence of sending out pulses in accordance with the sequence of row 0000 of Table 4 for two iterations of the sequence. Rows 1110, 1112, 1114, and 1116 show the pulses provided to connections 422, 420, 412, and 410 respectively. The times 1150, 1152, 1154, 1156, 1158, 1160, 1162, and 1164 identify the times when the pulses are provided. In this example, signal generator 500 produces 50 pps so the times of FIG. 11 are separated by 20 milliseconds. If the sequence of pulses of FIG. 11 were continued for one second 12.5 pulses would be provided per connection.

Figure 12:
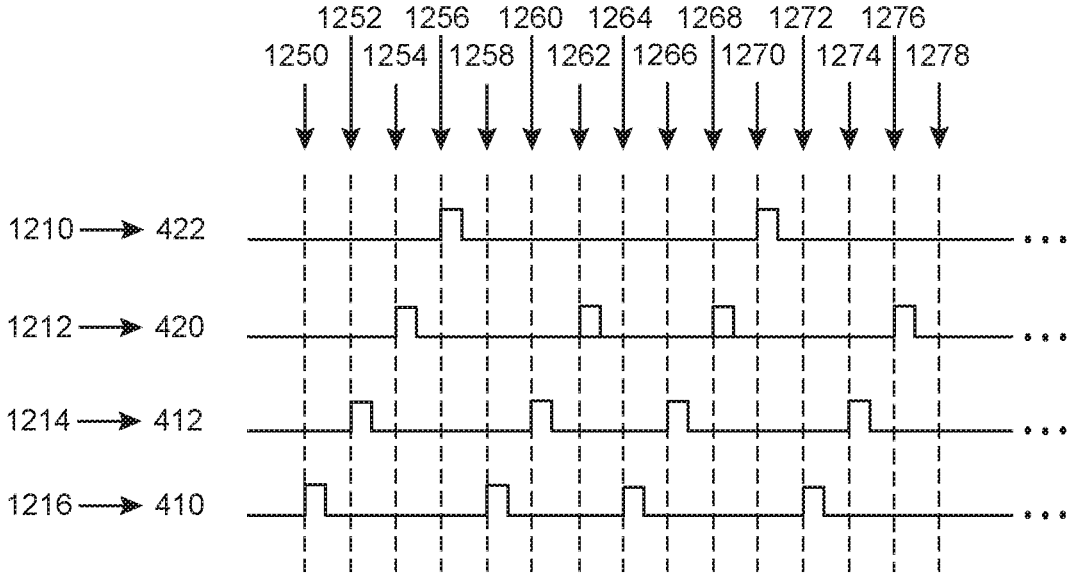

The diagram of FIG. 12 depicts a sequence of sending out pulses in accordance with the sequence of row 0111 of Table 4 for two iterations of the sequence. Rows 1210, 1212, 1214, and 1216 show the pulses provided on connections 422, 420, 412, and 410 respectively. The times 1250, 1252, 1254, 1256, 1258, 1260, 1262, 1264, 1266, 1268, 1270, 1272, 1274, 1276, and 1278 identify the times when the pulses are provided. Signal generator 500 produces 50 pps so the times of FIG. 12 are separated by 20 milliseconds. If the sequence of pulses of FIG. 12 were continued for one second, 7.1, 14.3, 14.3, and 14.3 pulses would be provided to connections 422, 420, 412, and 410 respectively.

Even though the above description of providing pulses according to a sequence provides only one pulse for each connection of the sequence, more than one pulse could be provided for some connections of the sequence while only one pulse could be provided to other connections of the sequence.

Figure 6:
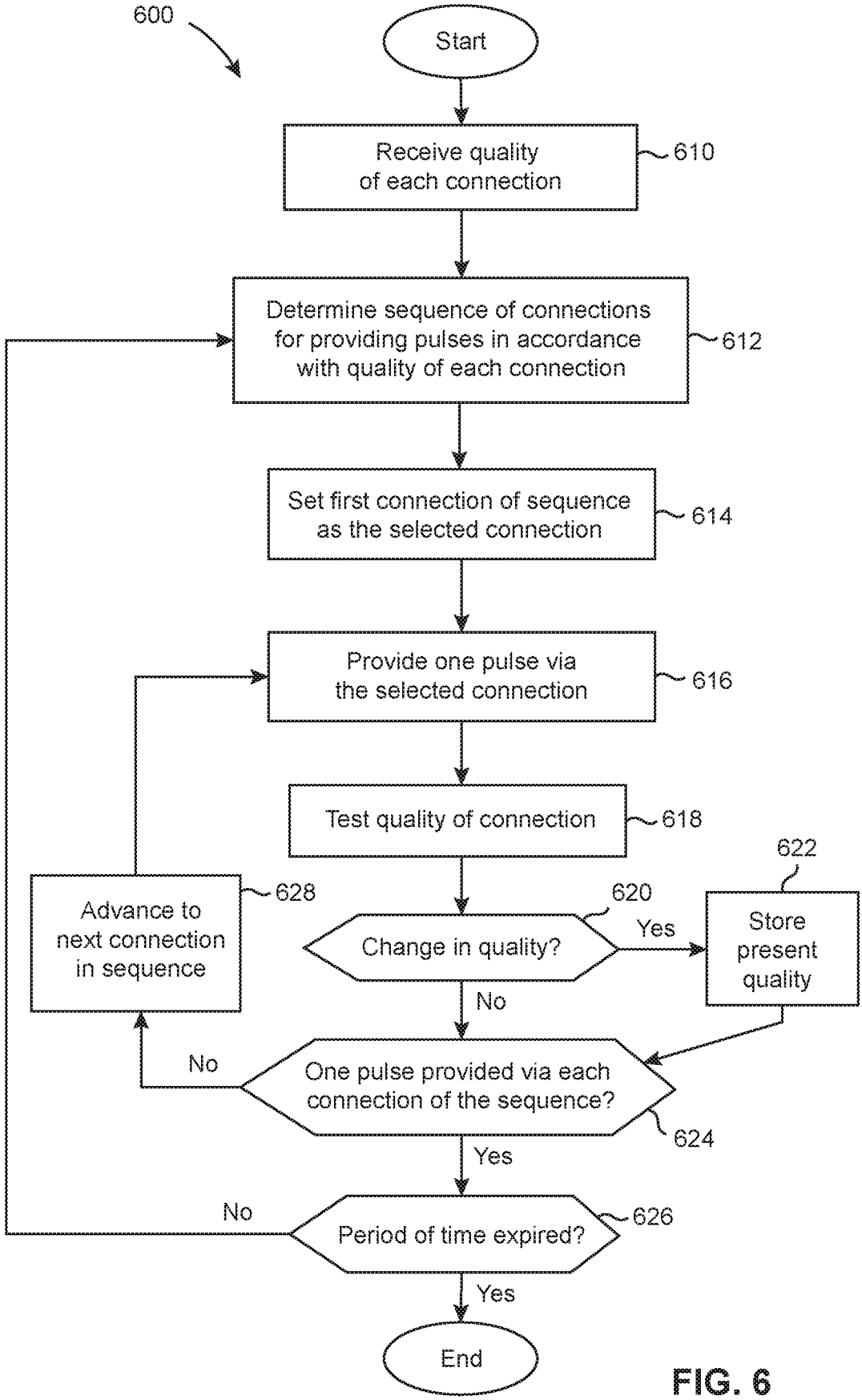
FIG. 6 is a diagram of a method for providing pulses of a stimulus signal in accordance with a sequence of connections according to various aspects of the present disclosure.

How pulses are provided in accordance with a sequence of connections is described above. With reference to FIG. 6, a method 600 for providing pulses in accordance with a sequence of connections is disclosed. In various embodiments, method 600 may comprise a computer-implemented method. For example, a computing system comprising a processor and a computer-readable medium may be implemented to perform method 600. The computer-readable medium may comprise instructions embodied thereon, wherein the instructions, in response to execution by the processor, cause the computing system to perform the operations of method 600.

Method 600 provides pulses in accordance with sequences for a period of time. In method 600, the period of time starts when the user of the CEW pulls the trigger to launch electrodes. The CEW continues to provide pulses of the stimulus signal until the period of time has elapsed. In many CEWs, the period of time is 5 second; however, the period of time may be extended by additional quantities of 5 seconds if the user does not release the trigger before the expiration of the present period of time.

Method 600 does not assume that the electrodes of all deployment units have been launched. The sequence is selected in accordance with the number of electrodes that have been launched and the quality of the connections between launched electrodes. If the electrodes of only one deployment unit have been launched (e.g., electrode 250 and 260 from deployment unit 240), pulses of current are provided via the only connection available at the maximum rate for a single connection (e.g., 22 pps).

Method 600 includes the steps of receive 610, determine 612, set 614, provide 616, test 618, change 620, store 622, provided 624, advance 628, and expired 626.

Upon pulling the trigger, execution of method 600 moves from start to receive 610. In receive 610, processing circuit 118 receives information regarding the quality of the connections between launched electrodes. If the electrodes have just been launched, receive 610 may include the testing of each connection by processing circuit 118. Since processing circuit 118 tests the quality of a connection each time a pulse is provided by signal generator 500, testing may occur upon launch of the electrodes. Test may continue during flight of the electrodes and after impact with a target. Execution moves to determine 612.

In determine 612, processing circuit 118 uses the information regarding the quality of the connections to determine a sequence of connections that should be used for providing pulses. For example, processing circuit 118 may use the quality information to find the row of Table 4 that corresponds to the quality of the various connections. Execution moves to set 614.

Once processing circuit has determined the sequence of connections it will use to provide pulses of the stimulus signal, processing circuit 118 selects the first connection from the sequence as the selected connection. Having determined the connection through which the pulse should be provided, processing circuit selects the transformers and thereby the electrodes associated with the selected connection as discussed above. Execution moves to provide 616.

In provide 616, the processing circuit instructs signal generator 500 to provide one pulse of the stimulus signal to the selected connection. Because processing circuit 118 has selected, using signals S1, S2, S3, or S4, the transformer and electrodes that will provide the pulse, the pulse is provided to the selected connection. Whether the charge of the pulse is delivered through the target depends on the quality of the connection. Execution moves test 618.

In test 618, as, during, and/or after the pulse is sent to the selected connection, processing circuit 118 tests the quality of the selected connection as discussed above (e.g., Equation 10). Processing circuit 118 records the quality of the connection as determined during testing. Execution moves to change 620.

In change 620, processing circuit 118 determines whether the quality of the selected connection has changed from its previous state. For example, if the quality of the connection was previously bad, and test 618 determined that the present quality of the connection is good, a change in the quality of the connection has occurred. If the previous quality of the connection and the quality as tested in test 618 are the same, then the quality of the connection has not changed. If the quality of the connection changed, execution moves to store 622. If the quality of the connection has not changed, execution moves to provided 624.

In store 622, processing circuit stores the new quality of the selected connection as the present quality of the connection. Processing circuit 118 maintains information as to the present quality of each connection. As the quality of the connection changes, processing circuit 118 updates its record of the present quality so that the present quality of each connection is known. After storing the new quality of the selected connection, execution moves to provided 624.

In provided 624, processing circuit 118 determines whether one pulse of stimulus signal has been provided via each connection of the sequence (e.g., processing circuit 118 determines whether it has reached the end of the sequence). If one pulse has been sent out to each connection of the sequence, the end of the sequence has been reached and execution moves to expired 626. If the end of the sequence has not been reached, execution moves to advance 628.

In advance 628, processing circuit 118 makes the next connection of the sequence with the selected connection. Execution moves to provide 616.

In expired 626, processing circuit determines whether the period of time (e.g., 5 seconds with possible extensions) has expired. If the period of time has expired, then processing circuit stops sending pulses out any connection and moves to the end of the method. If the time has not expired, execution moves to determine 612. When execution moves to determine 612 from expired 626, the quality of the connections may be different than when determine 612 was last executed. Because processing circuit 118 tests the quality of a connection each time a pulse is provided (e.g., test 618), the quality of one or more connections may be different, so a new sequence may be selected in determine 612.

For example, when determine 612 is first executed, the quality of the connections may be 1011 (e.g., good, bad, good, good), so the sequence of row 1011 of Table 4 is selected. While the sequence is being used, connection 420 changes from a bad connection to a good connection so the connections are now 1111 (e.g., good, good, good, good). When determine 612 is next executed, processing circuit 118 stops using the sequence of row 1011 and starts using the sequence of row 1111.

Figure 7:
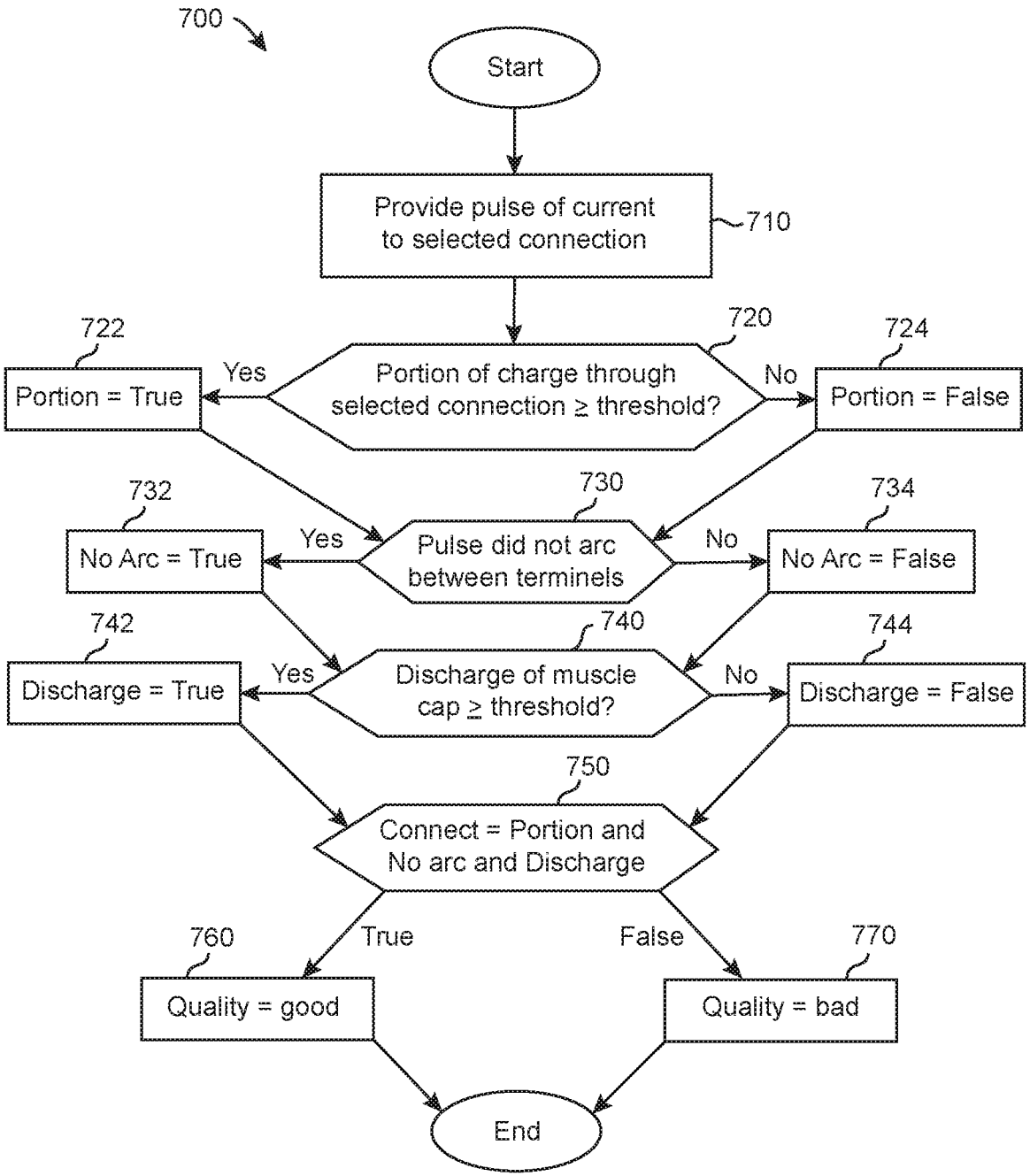
FIG. 7 is a diagram of a method for determining the quality of a connection according to various aspects of the present disclosure.

The terms of the Boolean equation in Equation 10 are discussed above. With reference to FIG. 7, a method 700 is an implementation of a method for determining the value of the terms of the Boolean equation of Equation 10 and the value (e.g., result) of the equation. Method 700 may be performed by a processing circuit in cooperation with a signal generator and/or one or more detectors as discussed above. A processing circuit may perform method 700 as part of receive 610 and/or test 618 of method 600, with brief reference to FIG. 6, to determine the quality of one or more connections. In various embodiments, method 700 may comprise a computer-implemented method. For example, a computing system comprising a processor and a computer-readable medium may be implemented to perform method 700. The computer-readable medium may comprise instructions embodied thereon, wherein the instructions, in response to execution by the processor, cause the computing system to perform the operations of method 700.

Method 700 includes the steps of provide 710, portion 720, portion true 722, portion false 724, arc 730, no arc true 732, no arc false 734, discharge 740, discharge true 742, discharge false 744, connection 750, quality good 760, and quality bad 770.

Method 700 may begin with provide 710. In provide 710, the signal generator provides a pulse of the stimulus signal to the selected connection. The selected connection is selected by the processing circuit. The processing circuit performs the operations needed to select a connection for providing the pulse as discussed above. The remaining steps (e.g., steps 720-770) may be performed as the signal generator provides the pulse and/or after the signal generator has provided the pulse, but before the next pulse is provided. Execution moves to portion 720.

In portion 720, the processing circuit in cooperation with the signal generator and/or the one or more detectors determines whether the portion of the charge of the pulse that flows through the selected connection is greater than or equal to a threshold. To determine the portion of the current that flows through the selected connection, the processing circuit may use any of the techniques and/or components discussed above. If the portion of the charge of the pulse that flows through the selected connection is greater than or equal to a threshold, execution moves to portion true 722. If the portion of the charge of the pulse that flows through the selected connection is less than the threshold, execution moves to portion false 724.

In portion true 722, the Boolean variable "portion" is set to true. Execution moves to arc 730.

In portion false 724, the Boolean variable "portion" is set to false. Execution moves to arc 730.

In arc 730, the processing circuit in cooperation with the signal generator and/or the one or more detectors determines whether the charge of the pulse arced (e.g., ionized) between terminals. To determine whether the charge of the pulse arced between terminals, the processing circuit may use any of the techniques and/or components discussed herein. If the charge of the pulse did not arc between terminals, execution moves to no arc true 732. If the charge of the pulse did arc between terminals, execution moves to no arc false 734.

In no arc true 732, the Boolean variable "no arc" is set to true. No arc true means that the pulse did not arc between terminals of the CEW. Execution moves to discharge 740.

In no arc false 734, the Boolean variable "no arc" is set to false. No arc false means that the pulse did arc between terminals of the CEW. Execution moves to discharge 740.

In discharge 740, the processing circuit in cooperation with the signal generator and/or the one or more detectors determines whether the signal generator (e.g., muscle capacitances) provided an amount of charge greater than or equal to a threshold. To determine whether the signal generator provided an amount of charge greater than or equal to a threshold, the processing circuit may use any of the techniques and/or components discussed above. If the amount of charge provided by the signal generator is greater than or equal to a threshold, execution moves to discharge true 742. If the amount of charge provided by the signal generator is less than the threshold, execution moves to discharge false 744.

In discharge true 742, the Boolean variable "discharge" is set to true. Execution moves to connection 750.

In discharge false 744, the Boolean variable "discharge" is set to false. Execution moves to connection 750.

In connection 750, the Boolean expression "connection=portion & no arc & discharge" is evaluated so that the Boolean variable "connection" is assigned a value of true or false. The Boolean expression of connection 750 is the same as the Boolean expression provided above as Equation 10, so evaluating the expression to determine a value for "connection" determines a quality of the selected connection. If the Boolean variable "connection" evaluates to true, execution moves to quality good 760. If the Boolean variable "connection" evaluates to false, execution moves to quality bad 770.

In quality good 760, the variable "quality" is set to "good" (or true, if Boolean). Execution moves to end.

In quality bad 770, the variable "quality" is set to "bad" (or false, if Boolean). Execution moves to end.

The value of the variable "quality" expresses the quality of a connection, as discussed herein. The processing circuit may use the value of the variable "quality" to determine whether the quality of the connection has changed. The processing circuit may compare the value of the variable "quality" as just evaluated against a prior value of the variable "quality" for the same connection to determine whether the quality of the connection has changed. The value of the variable "quality" may be used to select a sequence of connections for providing pulses of the stimulus signal.

The foregoing description discusses implementations (e.g., embodiments), which may be changed or modified without departing from the scope of the present disclosure as defined in the claims. Examples listed in parentheses may be used in the alternative or in any practical combination. As used in the specification and claims, the words "comprising," "comprises," "including," "includes," "having," and "has" introduce an open-ended statement of component structures and/or functions. In the specification and claims, the words "a" and "an" are used as indefinite articles meaning "one or more." While for the sake of clarity of description, several specific embodiments have been described, the scope of the invention is intended to be measured by the claims as set forth below. In the claims, the term "provided" is used to definitively identify an object that not a claimed element but an object that performs the function of a workpiece. For example, in the claim "an apparatus for aiming a provided barrel, the apparatus comprising: a housing, the barrel positioned in the housing," the "barrel" is not a claimed element of the apparatus, but an object that cooperates with the "housing" of the "apparatus" by being positioned in the "housing." Moreover, where a phrase similar to "at least one of A, B, or C" or "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The location indicators "herein," "hereunder," "above," "below," or other word that refer to a location, whether specific or general, in the specification shall be construed to refer to any location in the specification whether the location is before or after the location indicator.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods.

In general, functionality of computing devices described herein may be implemented in computing logic embodied in hardware or software instructions, which can be written in a programming language, such as C, C++, COBOL, JAVA, PHP, Perl, Python, Ruby, HTML, CSS, JavaScript, VBScript, ASPX, Microsoft .NET languages such as C#, and/or the like. Computing logic may be compiled into executable programs or written in interpreted programming languages. Generally, functionality described herein can be implemented as logic modules that can be duplicated to provide greater processing capability, merged with other modules, or divided into sub modules. The computing logic can be stored in any type of computer-readable medium (e.g., a non-transitory medium such as a memory or storage medium) or computer storage device and be stored on and executed by one or more general purpose or special purpose processors, thus creating a special purpose computing device configured to provide functionality described herein.

Many alternatives to the systems and devices described herein are possible. For example, individual modules or subsystems can be separated into additional modules or subsystems or combined into fewer modules or subsystems. As another example, modules or subsystems can be omitted or supplemented with other modules or subsystems. As another example, functions that are indicated as being performed by a particular device, processing circuit, module, or subsystem may instead be performed by one or more other devices, modules, processing circuits, or subsystems. Although some examples in the present disclosure include descriptions of devices comprising specific hardware components in specific arrangements, techniques and tools described herein can be modified to accommodate different hardware components, combinations, or arrangements. Further, although some examples in the present disclosure include descriptions of specific usage scenarios, techniques and tools described herein can be modified to accommodate different usage scenarios. Functionality that is described as being implemented in software can instead be implemented in hardware, or vice versa.

Many alternatives to the techniques described herein are possible. For example, processing stages in the various techniques can be separated into additional stages or combined into fewer stages. As another example, processing stages in the various techniques can be omitted or supplemented with other techniques or processing stages. As another example, processing stages that are described as occurring in a particular order can instead occur in a different order. As another example, processing stages that are described as being performed in a series of steps may instead be handled in a parallel fashion, with multiple modules or software processes concurrently handling one or more of the illustrated processing stages. As another example, processing stages that are indicated as being performed by a particular device or module may instead be performed by one or more other devices or modules.

Embodiments disclosed herein include a computer-implemented method (e.g., method 600 with brief reference to FIG. 6, method 700 with brief reference to FIG. 7) for performing one or more of the above-described techniques; a computing device comprising a processor and computer-readable storage media having stored thereon computer executable instructions configured to cause the computing device to perform one or more of the above described techniques; and/or a computer-readable storage medium having stored thereon computer executable instructions configured to cause a computing device to perform one or more of the above-described techniques.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the claimed subject matter.

What is claimed is:

1. A method for providing a stimulus signal through a human or animal target, the stimulus signal includes a series of current pulses, the stimulus signal for impeding locomotion of the target, the method comprising:

selecting a first sequence of connections, the first sequence of connections includes an ordered list of two or more connections;

setting a first connection of the first sequence of connections as a selected connection;

providing one pulse of the stimulus signal to the selected connection;

while providing the one pulse, determining a quality of the selected connection;

setting a next connection of the first sequence of connections as the selected connection, wherein the first connection of the first sequence of connections follows a last connection of the first sequence of connections with respect to setting the selected connection;

repeating providing, determining, and setting the next connection for a period of time; and selecting a next sequence of connections based on the quality of one or more of the two or more connections of the first sequence of connections.

2. The method of claim 1 wherein determining comprises detecting:

whether an amount of charge that flows through the selected connection is greater than a first threshold;

whether a charge of the one pulse arced between terminals; and whether a signal generator provide an amount of charge greater than a second threshold.

3. The method of claim 1 wherein at least one of setting the first connection and setting the next connection comprises selecting a first wire-tethered electrode and a second wire-tethered electrode associated with the selected connection.

4. The method of claim 1 wherein providing the one pulse of the stimulus signal comprises energizing the selected connection with the one pulse of the stimulus signal.

5. The method of claim 1 wherein providing the one pulse of the stimulus signal comprises delivering a charge of the one pulse through the target via the selected connection if the quality of the selected connection is good.

6. The method of claim 1 wherein providing the one pulse of the stimulus signal comprises not delivering a charge of the one pulse through the target via the selected connection if the quality of the selected connection is bad.

7. The method of claim 1 wherein repeating comprises providing pulses of the stimulus signal to connections whose quality is good at a first maximum rate.

8. The method of claim 7 wherein the first maximum rate is 22 pulses per second.

9. The method of claim 1 wherein repeating comprises providing pulses of the stimulus signal to all connections of the first sequence of connections at a second maximum rate, the second maximum rate is a sum of all pulse rates for each connections of the first sequence of connections.

10. The method of claim 9 wherein the second maximum rate is 44 pulses per second.

11. The method of claim 1 wherein repeating comprises:

providing pulses of the stimulus signal to connections whose quality is good at a first maximum rate; and providing pulses of the stimulus signal to all connections of the first sequence of connections at a second maximum rate; wherein:

the first maximum rate is between 11 pulses per second and 50 pulses per second; and the second maximum rate is between 22 pulse per second and 50 pulses per second.

12. A conducted electrical weapon ("CEW") for providing a stimulus signal through a target, the stimulus signal for impeding locomotion of the target, the CEW comprising:

a processing circuit;

a signal generator, the signal generator provides the stimulus signal, the stimulus signal including a series of pulses; and three or more electrodes electrically coupled to the signal generator, the three or more electrodes for launching toward the target to provide the stimulus signal through the target to impede locomotion of the target; wherein the processing circuit and the signal generator cooperate to:

set a first connection of a first sequence of connections as a selected connection, the first sequence of connections includes an ordered list of two or more connections;

select two selected electrodes from the three or more electrodes in accordance with the selected connection;

provide one pulse of the stimulus signal to the two selected electrodes;

while providing the one pulse of the stimulus signal, determine a quality of the selected connection;

set a next connection of the first sequence of connections as the selected connection, the first connection of the first sequence of connections follows a last connection of the first sequence of connections;

repeat select, provide, determine, and set for a period of time; and select a next sequence of connections based on the quality of one or more of the two or more connections of the first sequence of connections.

13. The CEW of claim 12 wherein:

the signal generator comprises three or more transformers and three or more switches;

a secondary winding of each transformer coupled to one electrode from the three or more electrodes respectively;

a primary winding of each transformer coupled to one switch respectively; and the processing circuit controls the three or more switches to provide the one pulse of the stimulus signal to the two selected electrodes.

14. The CEW of claim 12 wherein to determine the quality of the selected connection:

the processing circuit and signal generator further cooperate to detect:

whether an amount of charge that flows through the selected connection is greater than a first threshold;

whether a charge of the one pulse arced between terminals of the CEW; and whether the signal generator provides an amount of charge greater than a second threshold; and the processing circuit determines the quality of the selected connection in accordance with detecting.

15. The CEW of claim 12 further comprising a memory, wherein:

the first sequence of connections is stored in the memory; and the processing circuit reads the first sequence of connections from the memory.

16. The CEW of claim 12 wherein the processing circuit and signal generator repeat to:

provide a first maximum pulse rate to each connection of the first sequence of connections whose quality is good; and provide a second maximum pulse rate to all connections of the first sequence of connections, the second maximum pulse rate is a sum of all pulse rates for each connection of the first sequence of connections.

17. The CEW of claim 16 wherein the first maximum rate is between 11 pulses per second and 50 pulses per second.

18. The CEW of claim 16 wherein the second maximum rate is between 22 pulses per second and 50 pulses per second.

19. The CEW of claim 12 wherein each pair of electrodes selected from the three or more electrodes corresponds to one connection of the first sequence of connections.

20. A method comprising:

receiving, by a processor, a first quality of connection for each pair of electrodes from two or more pairs of electrodes;

determining, by the processor, a first sequence of connections based on the first quality of connection, wherein the first sequence of connections comprises an ordered list of a plurality of connections, and wherein each connection of the plurality of connections comprises a pair of electrodes from the two or more pairs of electrodes;

providing, by the processor, one pulse of a stimulus signal to each connection from the plurality of connections based on the ordered list from the first sequence of connections;

determining, by the processor, a second quality of connection for each pair of electrodes; and in response to the second quality of connection for any pair of electrodes being different than in the first quality of connection, selecting, by the processor, a second sequence of connections based on the second quality of connection.

* * * * *